US010717509B2

(12) United States Patent
Schroeder

(10) Patent No.: US 10,717,509 B2
(45) Date of Patent: Jul. 21, 2020

(54) TROLLING MOTOR SYSTEM WITH DAMAGE PREVENTION FEEDBACK MECHANISM AND ASSOCIATED METHODS

(71) Applicant: NAVICO HOLDING AS, Egersund (NO)

(72) Inventor: Jeremy J. Schroeder, Sapulpa, OK (US)

(73) Assignee: NAVICO HOLDING AS, Egersund (NO)

( * ) Notice: Subject to any disclaimer, the term of this patent is extended or adjusted under 35 U.S.C. 154(b) by 0 days.

(21) Appl. No.: 16/290,015

(22) Filed: Mar. 1, 2019

(65) Prior Publication Data

US 2020/0172219 A1 Jun. 4, 2020

Related U.S. Application Data

(63) Continuation-in-part of application No. 16/208,944, filed on Dec. 4, 2018.

(51) Int. Cl.

| | |
|---|---|
| ***B63H 20/14*** | (2006.01) |
| ***B63H 20/12*** | (2006.01) |
| ***B63H 20/00*** | (2006.01) |

(52) U.S. Cl.

CPC ..... *B63H 20/14* (2013.01); *B63H 20/007* (2013.01); *B63H 20/12* (2013.01)

(58) Field of Classification Search

CPC ..... B60L 15/20; B63H 20/00; B63H 20/007; B63H 20/12; B63H 20/14; B63H 20/42;

(Continued)

(56) References Cited

U.S. PATENT DOCUMENTS

| | | | |
|---|---|---|---|
| 2,804,838 | A | 9/1957 | Moser |
| 4,820,208 | A | 4/1989 | Phillips, Sr. |

(Continued)

FOREIGN PATENT DOCUMENTS

| | | | |
|---|---|---|---|
| CA | 2 895 863 | A1 | 1/2016 |
| DE | 10 2007 009563 | A1 | 8/2008 |

(Continued)

OTHER PUBLICATIONS

Minn Kota Ultrex Trolling Motor (5 pgs.) Website visited Feb. 20, 2019 https://minnkotamotors.johnsonoutdoors.com/freshwater-trolling-motors/ultrex.

(Continued)

*Primary Examiner* — Lars A Olson

(74) *Attorney, Agent, or Firm* — Nelson Mullins Riley & Scarborough LLP

(57) ABSTRACT

An example trolling motor assembly that includes a shaft with an attached trolling motor and a foot pedal is provided herein. Deflection of the foot pedal causes a corresponding rotation in a direction the trolling motor is oriented. A feedback device is coupled with the foot pedal and configured to provide at least one of haptic, audible, or visual feedback to indicate to a user that rotation of the direction of the trolling motor has stalled or is about to stall. In some cases, the feedback device may be present in a handheld remote control device. Example determination that rotation of the direction of the trolling motor has stalled or is about to stall may occur when the user directed rotation input and the actual orientation of the trolling motor are out of sync and/or when a current draw from a motor for rotating the trolling motor is too large.

20 Claims, 28 Drawing Sheets

(58) Field of Classification Search
CPC ..... B63H 21/00; B63H 21/17; B63H 21/21; B63H 21/26; B63H 25/00; B63H 25/02; B63H 25/42
USPC ..... 440/1, 7
See application file for complete search history.

(56) References Cited

U.S. PATENT DOCUMENTS

| | | | | |
|---|---|---|---|---|
| 6,054,831 | A | 4/2000 | Moore et al. | |
| 6,447,347 | B1 | 9/2002 | Steinhauser | |
| 6,507,164 | B1 | 1/2003 | Healey et al. | |
| 6,524,144 | B2 | 2/2003 | Pasley | |
| 6,661,742 | B2 | 12/2003 | Hansen | |
| 6,678,589 | B2 | 1/2004 | Robertson et al. | |
| 6,870,794 | B2 | 3/2005 | Healey | |
| 6,902,446 | B1 | 6/2005 | Healey | |
| 6,919,704 | B1 | 7/2005 | Healey | |
| 7,004,804 | B2 | 2/2006 | Bernloehr et al. | |
| 7,195,526 | B2 | 3/2007 | Bernloehr et al. | |
| 7,303,595 | B1 | 12/2007 | Janitz | |
| 7,538,511 | B2 | 5/2009 | Samek | |
| D594,034 | S | 6/2009 | Bernloehr et al. | |
| 7,722,417 | B2 | 5/2010 | Bernloehr et al. | |
| 8,106,617 | B1 | 1/2012 | Holley | |
| 8,305,844 | B2 | 11/2012 | DePasqua | |
| 8,645,012 | B2 | 2/2014 | Salmon et al. | |
| 8,761,976 | B2 | 6/2014 | Salmon et al. | |
| 8,814,129 | B2 | 8/2014 | Todd et al. | |
| 8,879,359 | B2 | 11/2014 | DePaaqua | |
| 9,127,707 | B1 | 9/2015 | Huntley | |
| 9,132,900 | B2 | 9/2015 | Salmon et al. | |
| 9,160,210 | B2 | 10/2015 | Perry | |
| 9,162,743 | B2 | 10/2015 | Grace et al. | |
| 9,278,745 | B2 | 3/2016 | Kooi, Jr. et al. | |
| 9,290,256 | B1 | 3/2016 | Wireman et al. | |
| 9,296,455 | B2 | 3/2016 | Bernloehr et al. | |
| 9,676,462 | B2 | 6/2017 | Bernloehr et al. | |
| 10,513,322 | B2 * | 12/2019 | Clark | B63H 21/21 |
| 2002/0102888 | A1 | 8/2002 | Pasley | |
| 2003/0191562 | A1 | 10/2003 | Robertson et al. | |
| 2003/0203684 | A1 | 10/2003 | Healey | |
| 2005/0257761 | A1 | 11/2005 | Hayase et al. | |
| 2006/0116031 | A1 | 6/2006 | Bernloehr et al. | |
| 2009/0037040 | A1 | 2/2009 | Salmon et al. | |
| 2009/0227158 | A1 | 9/2009 | Bernloehr et al. | |
| 2010/0116967 | A1 | 5/2010 | Todd et al. | |
| 2012/0014220 | A1 | 1/2012 | DePasqua | |
| 2012/0015566 | A1 | 1/2012 | Salmon | |
| 2012/0204467 | A1 | 8/2012 | Palmer et al. | |
| 2012/0232719 | A1 | 9/2012 | Salmon et al. | |
| 2013/0044569 | A1 | 2/2013 | DePasqua | |
| 2013/0215719 | A1 | 8/2013 | Betts et al. | |
| 2014/0203162 | A1 | 7/2014 | Logan | |
| 2014/0249698 | A1 | 9/2014 | Salmon et al. | |
| 2014/0269164 | A1 | 9/2014 | Betts et al. | |
| 2014/0277851 | A1 | 9/2014 | Grace et al. | |
| 2014/0336854 | A1 | 11/2014 | Salmon et al. | |
| 2015/0016130 | A1 | 1/2015 | Davis et al. | |
| 2015/0063059 | A1 | 3/2015 | DePasqua | |
| 2015/0063060 | A1 | 3/2015 | DePasqua | |
| 2015/0151824 | A1 | 6/2015 | Wireman | |
| 2015/0346729 | A1 | 12/2015 | Grace et al. | |
| 2016/0016651 | A1 | 1/2016 | Anderson et al. | |
| 2019/0176950 | A1 | 6/2019 | Whiteside et al. | |

FOREIGN PATENT DOCUMENTS

| | | | |
|---|---|---|---|
| DE | 10 2014 106826 | A1 | 11/2015 |
| EP | 1 891 461 | B1 | 5/2014 |
| WO | WO 95/28682 | | 10/1995 |
| WO | WO 2004/005063 | A1 | 1/2004 |
| WO | WO 2013/126761 | A1 | 8/2013 |
| WO | WO 2014/144471 | A1 | 9/2014 |

OTHER PUBLICATIONS

MotorGuide® Product Guide—The Digital Advantage (48 pgs.) Downloaded Feb. 22, 2019 http://www.motorguide.com/userfiles/file/catalog/2004.pdf.

U.S. Appl. No. 15/835,752, filed Dec. 8, 2017, entitled "Foot Pedal for a Trolling Motor Assembly".

U.S. Appl. No. 16/208,944, filed Dec. 4, 2018, entitled "Foot Pedal for a Trolling Motor Assembly".

* cited by examiner

TROLLING MOTOR SYSTEM WITH DAMAGE PREVENTION FEEDBACK MECHANISM AND ASSOCIATED METHODS

CROSS-REFERENCE TO RELATED APPLICATION(S)

The present application claims priority to and is a continuation-in-part of U.S. application Ser. No. 16/208,944, filed Dec. 4, 2018, entitled "Foot Pedal For a Trolling Motor Assembly," which is incorporated by reference herein in its entirety.

FIELD OF THE INVENTION

Embodiments of the present invention relate generally to trolling motor systems and, more particularly, to systems, assemblies, and associated methods for providing haptic, audible, and/or visual feedback to help prevent damage to a trolling motor assembly during rotation of the shaft of the trolling motor.

BACKGROUND OF THE INVENTION

Trolling motors are often used during fishing or other marine activities. The trolling motors attach to the watercraft and propel the watercraft along a body of water. For example, trolling motors may provide secondary propulsion or precision maneuvering that can be ideal for fishing activities. The trolling motors, however, may also be utilized for the main propulsion system of watercraft. Accordingly, trolling motors offer benefits in the areas of ease of use and watercraft maneuverability, among other things. That said, further innovation with respect to the operation/control of trolling motors is desirable. Applicant has developed systems, assemblies, and methods detailed herein to improve capabilities of trolling motors, such as by enabling prevention of damage to the trolling motor.

BRIEF SUMMARY OF THE INVENTION

Depending on the desired activity, an operator or user of the watercraft with the trolling motor may wish to remotely operate the trolling motor (e.g., not have to be positioned directly adjacent the trolling motor and/or have "hands free" control thereof). In this regard, the user may want to utilize a user input assembly such as, but not limited to, a foot pedal. Additionally or alternatively, a user may operate a remote control device (or remote computing device) for operating the trolling motor.

Some foot pedal assemblies for controlling the operation of trolling motors provide an electrical signal based on a foot pedal position to electronically steer the trolling motor. The electrical signal is provided to a controller that, in turn, controls a steering assembly to change the trolling motor's position/direction and, thus, propulsion direction. This contrasts with a traditional, mechanical style in which movement of a pedal pulls mechanical cables that manually articulate the trolling motor's position/direction and, thus, propulsion direction.

Remote control devices or other remote computing devices (such as connected marine electronic displays) may also be used to remotely control operation of trolling motors. A user may provide input to the device and the trolling motor may receive a signal to operate accordingly, such as through a controller that, in turn, controls a steering assembly to change the trolling motor's position/direction.

Trolling motors often operate in shallow water and, thus, the trolling motor housing that is submerged in the water may be prone to various hazards, such as bumping into rocks, getting tangled in seaweed, stuck in mud, among other things. As a result, attempts to turn the trolling motor housing (e.g., the direction the trolling motor housing faces) may not work and/or could result in damage if the trolling motor housing is in a hazard situation. As an example, the steering assembly of the trolling motor may stall or begin stalling if a user is attempting to turn the direction the trolling motor housing faces while the trolling motor housing is stuck or otherwise limited or prevented from further turning. This can result in damage to the steering assembly and/or trolling motor.

Some embodiments of the present invention provide systems that are designed to sense occurrence of such a stall and/or prior to the occurrence of the stall and, in response, provide feedback to the user to alert them. In response, the user can stop further input and, thus, further attempted turning of the trolling motor housing to prevent damage from occurring. Various embodiments of the present invention contemplate providing haptic, audible, and/or visual feedback to the user input assembly (e.g., foot pedal) and/or a remote control device.

In an example embodiment, a trolling motor system is provided. The trolling motor system comprises a trolling motor assembly configured for attachment to a watercraft. The trolling motor assembly comprises a shaft defining a first axis, wherein the shaft defines a first end and a second end. The trolling motor assembly further comprises a trolling motor at least partially contained within a trolling motor housing. The trolling motor housing is attached to the second end of the shaft. When the trolling motor assembly is attached to the watercraft and the trolling motor housing is submerged in a body of water, the trolling motor, when operating, is configured to propel the watercraft to travel along the body of water. The trolling motor system includes a user input assembly comprising a support plate and a foot pedal pivotably mounted to the support plate about a second axis. The foot pedal defines a top surface that is configured to receive a user's foot thereon. Deflection of the foot pedal about the second axis causes a corresponding rotation in a direction the trolling motor housing is oriented about the first axis. The user input assembly includes a feedback device coupled with the foot pedal and configured to provide at least one of haptic, audible, or visual feedback to indicate to the user that rotation of the direction of the trolling motor housing has stalled or is about to stall. The trolling motor system further includes a processor and a memory including computer program code. The computer program code is configured to, when executed, cause the processor to determine that rotation of the trolling motor housing about the first axis has stalled or is about to stall; and cause, in response to determining that rotation of the trolling motor housing about the first axis has stalled or is about to stall, the feedback device to provide the at least one of haptic, audible, or visual feedback.

In some embodiments, the trolling motor system further comprises a steering assembly configured to steer the trolling motor housing about the first axis to a plurality of directions in response to deflection of the foot pedal about the second axis. In some embodiments, the trolling motor system further comprises an orientation sensor configured to determine the orientation of the direction of the trolling motor housing and a position sensor configured to determine a deflected position of the foot pedal. The computer program code is configured to determine that rotation of the trolling motor housing about the first axis has stalled or is about to stall based on orientation data from the orientation sensor and position data from the position sensor. In some embodiments, the computer program code is configured to determine an expected orientation of the trolling motor housing based on position data from the position sensor; and determine that rotation of the trolling motor housing about the first axis has stalled or is about to stall in an instance in which an actual orientation of the trolling motor housing is different than the expected orientation of the trolling motor housing.

In some embodiments, the trolling motor system further comprises a motor current sensor configured to sense current draw utilized by a motor of the steering assembly during operation of the steering assembly to steer the trolling motor housing about the first axis. The computer program code is configured to determine that rotation of the trolling motor housing about the first axis has stalled or is about to stall based on monitored current draw of the motor from the motor current sensor. In some embodiments, the computer program code is configured to compare a current draw of the motor during operation to a predetermined current draw threshold; and determine that rotation of the trolling motor housing about the first axis has stalled or is about to stall in an instance in which the current draw of the motor is greater than the predetermined current draw threshold.

In some embodiments, the processor is positioned within the trolling motor assembly.

In some embodiments, the processor is positioned within the user input assembly.

In another example embodiment, a user input assembly for controlling operation of a trolling motor assembly is provided. The trolling motor assembly comprises a trolling motor, wherein the trolling motor is at least partially contained within a trolling motor housing. The trolling motor housing is attached to a shaft of the trolling motor assembly and configured to rotate about a first axis of the shaft. The user input assembly comprises a support plate and a foot pedal pivotably mounted to the support plate about a second axis. The foot pedal defines a top surface that is configured to receive a user's foot thereon. Deflection of the foot pedal about the second axis causes a corresponding rotation in a direction the trolling motor housing is oriented about the first axis. The user input assembly comprises a feedback device coupled with the foot pedal and configured to provide at least one of haptic, audible, or visual feedback to indicate to the user that rotation of the direction of the trolling motor housing has stalled or is about to stall.

In some embodiments, the user input assembly further comprises a processor and a memory including computer program code configured to, when executed, cause the processor to determine that rotation of the trolling motor housing about the first axis has stalled or is about to stall; and cause, in response to determining that rotation of the trolling motor housing about the first axis has stalled or is about to stall, the feedback device to provide the at least one of haptic, audible, or visual feedback. In some embodiments, the user input assembly further comprises a position sensor configured to determine a deflected position of the foot pedal. The computer program code is configured to determine that rotation of the trolling motor housing about the first axis has stalled or is about to stall based on orientation data from an orientation sensor of the trolling motor assembly and position data from the position sensor. The orientation sensor is configured to determine the orientation of the direction of the trolling motor housing. In some embodiments, the computer program code is configured to determine an expected orientation of the trolling motor housing based on position data from the position sensor; and determine that rotation of the trolling motor housing about the first axis has stalled or is about to stall in an instance in which an actual orientation of the trolling motor housing is different than the expected orientation of the trolling motor housing.

In some embodiments, the computer program code is configured to determine that rotation of the trolling motor housing about the first axis has stalled or is about to stall based on monitored current draw from a motor current sensor. The motor current sensor is configured to sense current draw utilized by a motor of a steering assembly during operation of the steering assembly to steer the trolling motor housing about the first axis. In some embodiments, the computer program code is configured to compare a current draw of the motor during operation to a predetermined current draw threshold; and determine that rotation of the trolling motor housing about the first axis has stalled or is about to stall in an instance in which the current draw of the motor is greater than the predetermined current draw threshold.

In yet another example embodiment, a trolling motor system is provided. The trolling motor system comprises a trolling motor assembly configured for attachment to a watercraft. The trolling motor assembly comprises a shaft defining a first axis, wherein the shaft defines a first end and a second end. The trolling motor assembly further includes a trolling motor at least partially contained within a trolling motor housing. The trolling motor housing is attached to the second end of the shaft. When the trolling motor assembly is attached to the watercraft and the trolling motor housing is submerged in a body of water, the trolling motor, when operating, is configured to propel the watercraft to travel along the body of water. The trolling motor system further includes a handheld remote control device comprising a user interface configured to receive user input from a user, wherein the user input causes rotation in a direction the trolling motor housing is oriented about the first axis. The remote control device further includes a wired or wireless communication element and a feedback device configured to provide at least one of haptic, audible, or visual feedback to indicate to the user of the handheld remote control device that rotation of the direction of the trolling motor housing has stalled or is about to stall. The trolling motor system further includes a processor and a memory including computer program code configured to, when executed, cause the processor to determine that rotation of the trolling motor housing about the first axis has stalled or is about to stall; and cause, in response to determining that rotation of the trolling motor housing about the first axis has stalled or is about to stall, the feedback device to provide the at least one of haptic, audible, or visual feedback.

In some embodiments, the trolling motor system further comprises a steering assembly configured to steer the trolling motor housing about the first axis to a plurality of directions in response to deflection of the foot pedal about the second axis. In some embodiments, the trolling motor system further comprises an orientation sensor configured to determine the orientation of the direction of the trolling motor housing. The computer program code is configured to determine that rotation of the trolling motor housing about the first axis has stalled or is about to stall based on orientation data from the orientation sensor. In some embodiments, the trolling motor system further comprises a motor current sensor configured to sense current draw utilized by a motor of the steering assembly during operation of the steering assembly to steer the trolling motor housing about the first axis. The computer program code is configured to determine that rotation of the trolling motor housing about the first axis has stalled or is about to stall based on monitored current draw of the motor from the motor current sensor.

In some embodiments, the processor is positioned within the trolling motor assembly.

In some embodiments, the processor is positioned within the handheld remote control device.

BRIEF DESCRIPTION OF THE DRAWINGS

Figure 1:
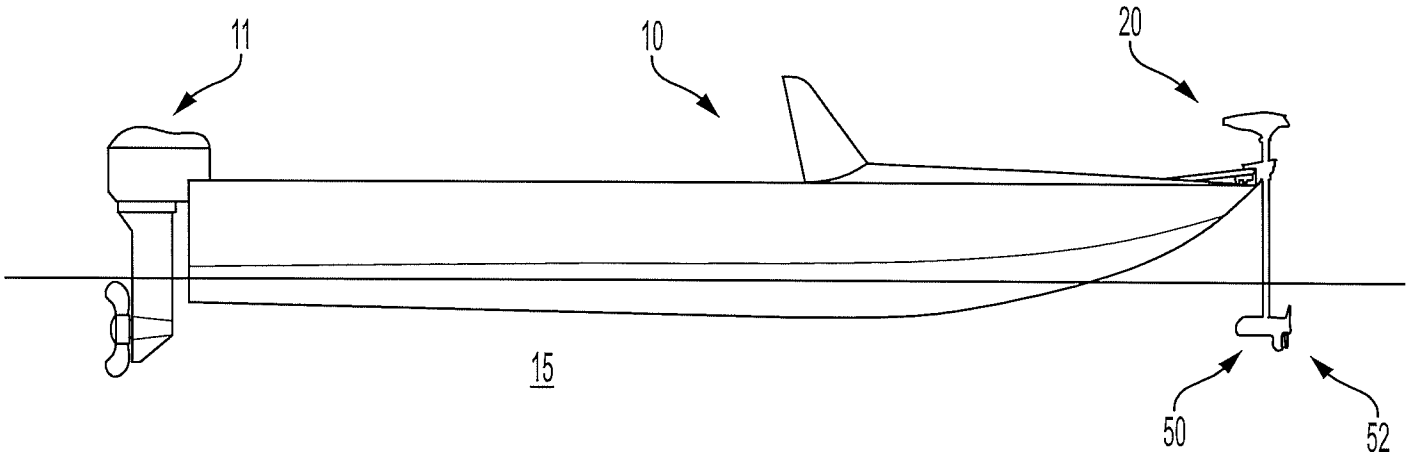
Figure 2:
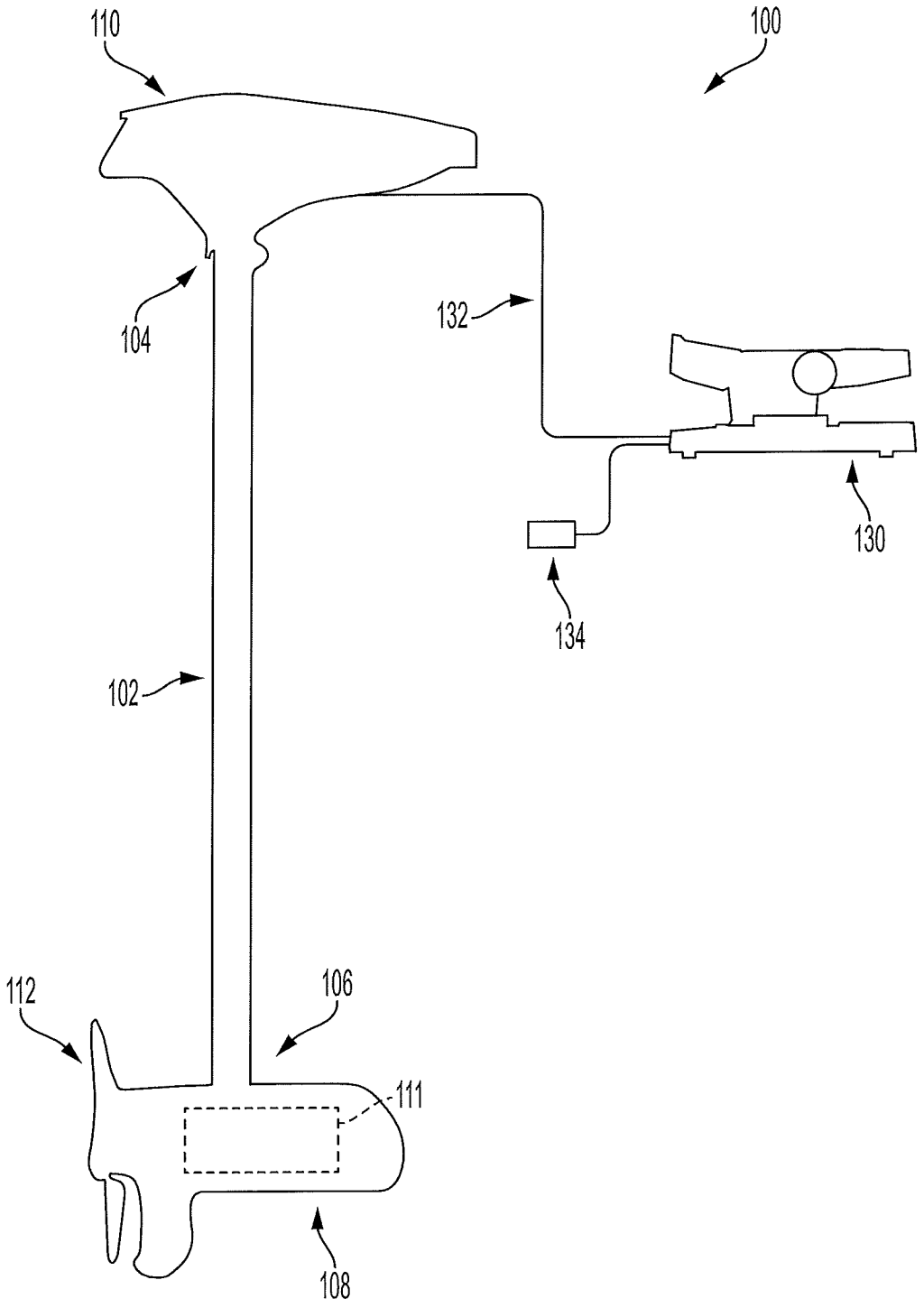
Figure 3:
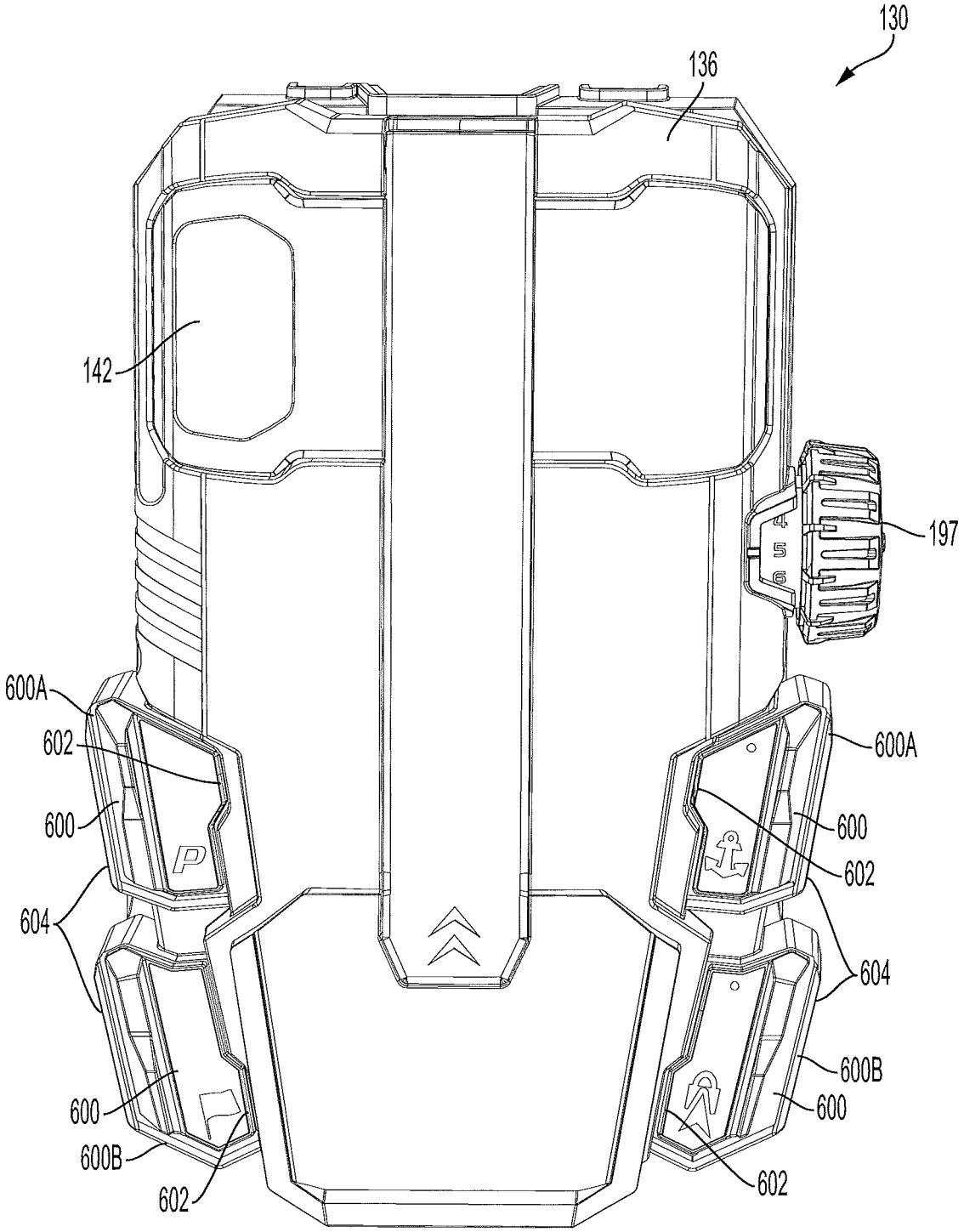
Figure 4:
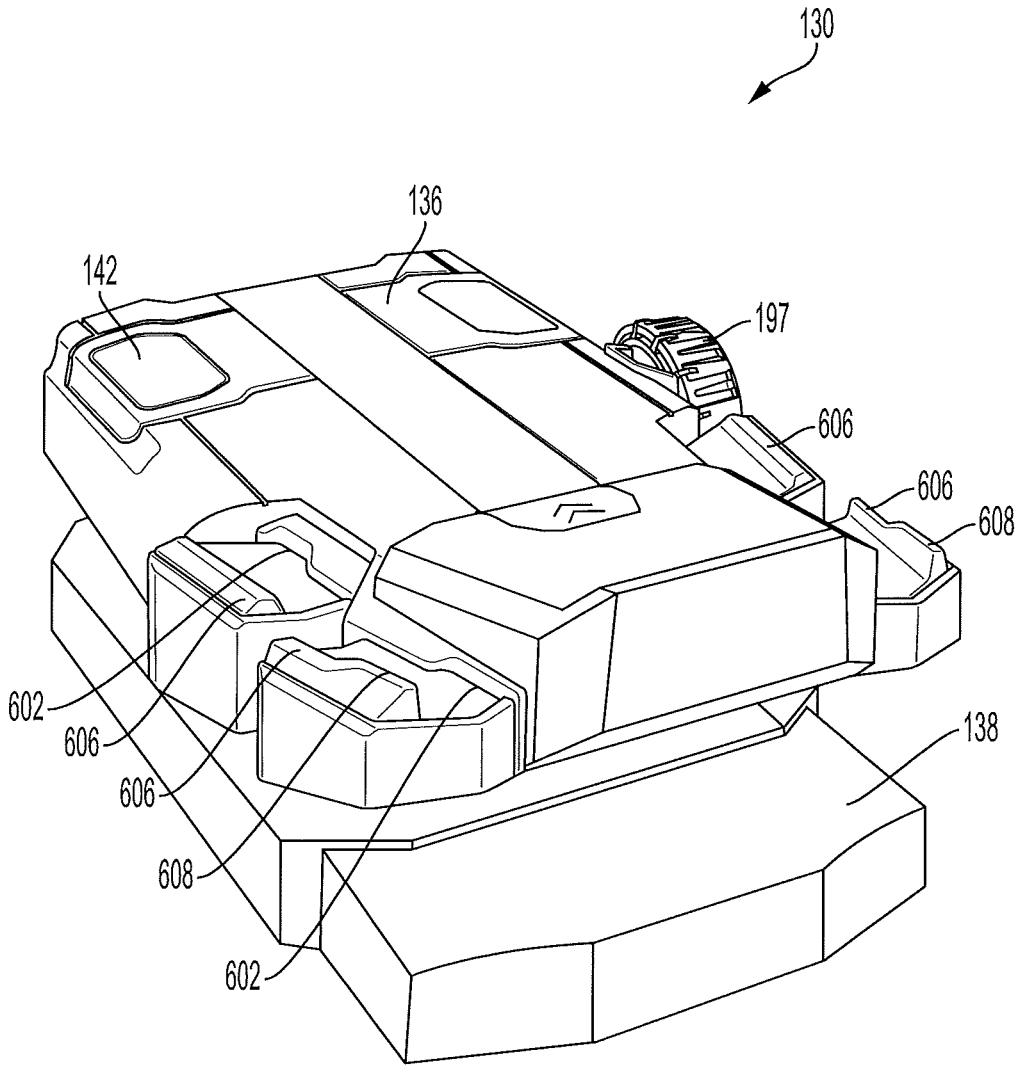
Figure 5:
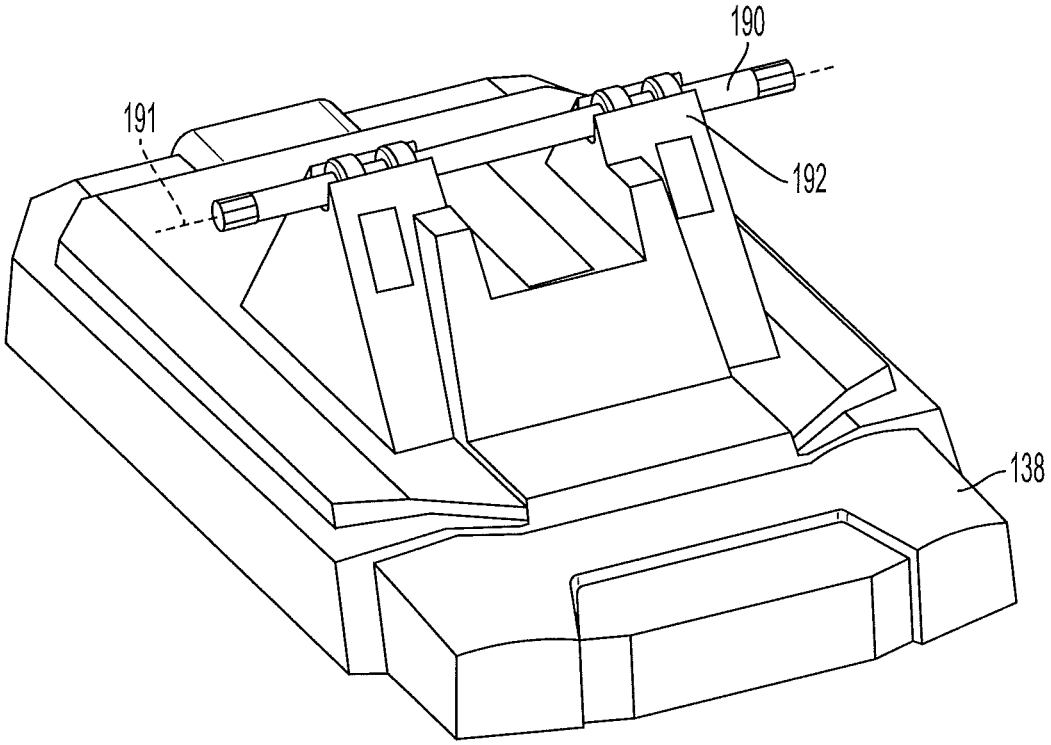
Figure 6:
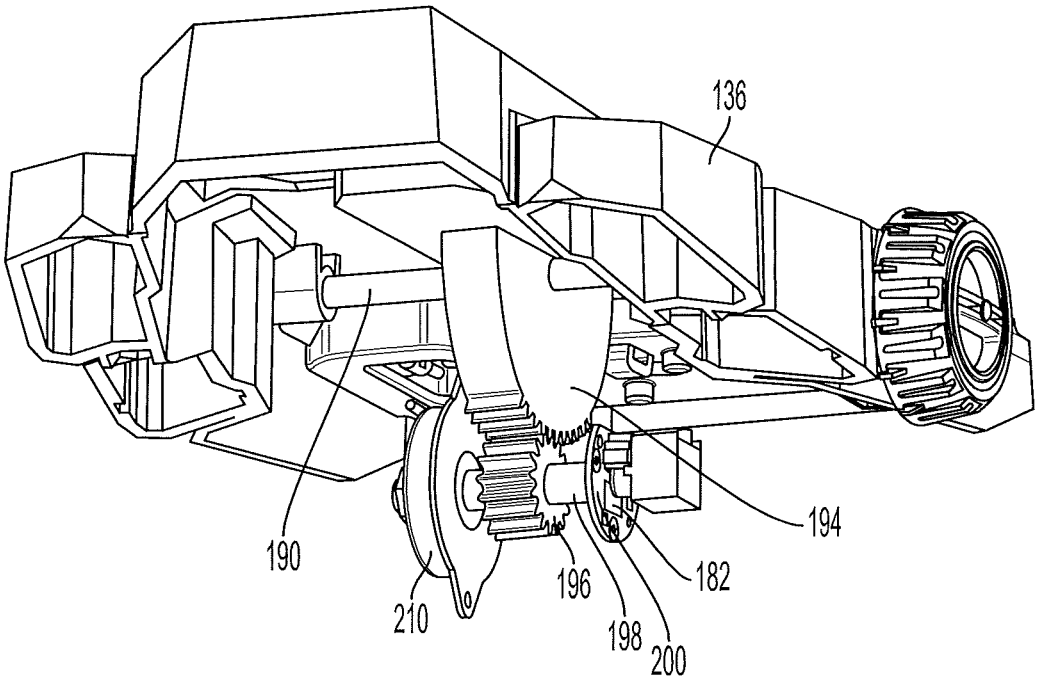
Figure 7:
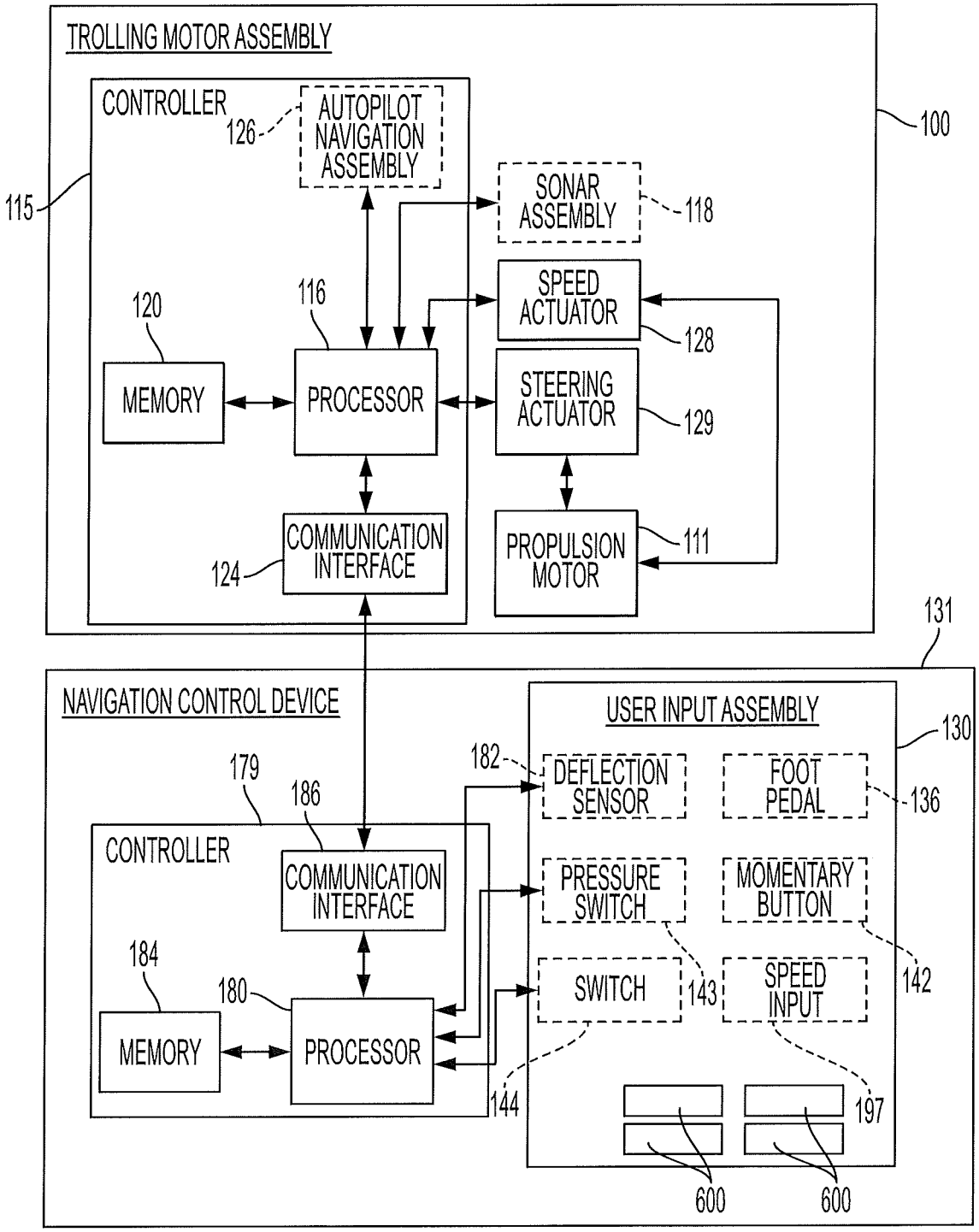
Figure 8:
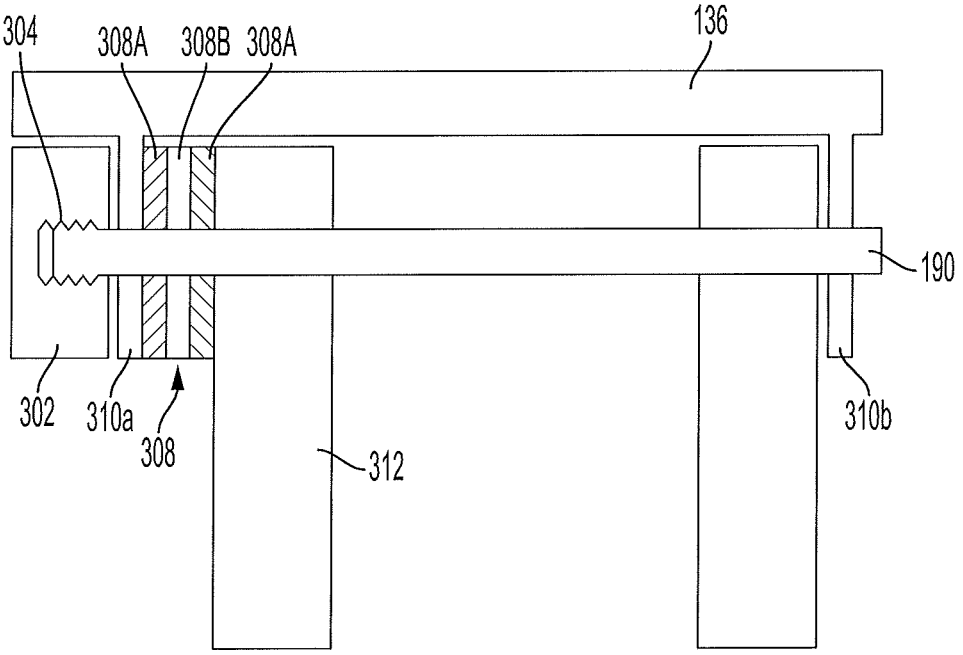
Figure 9:
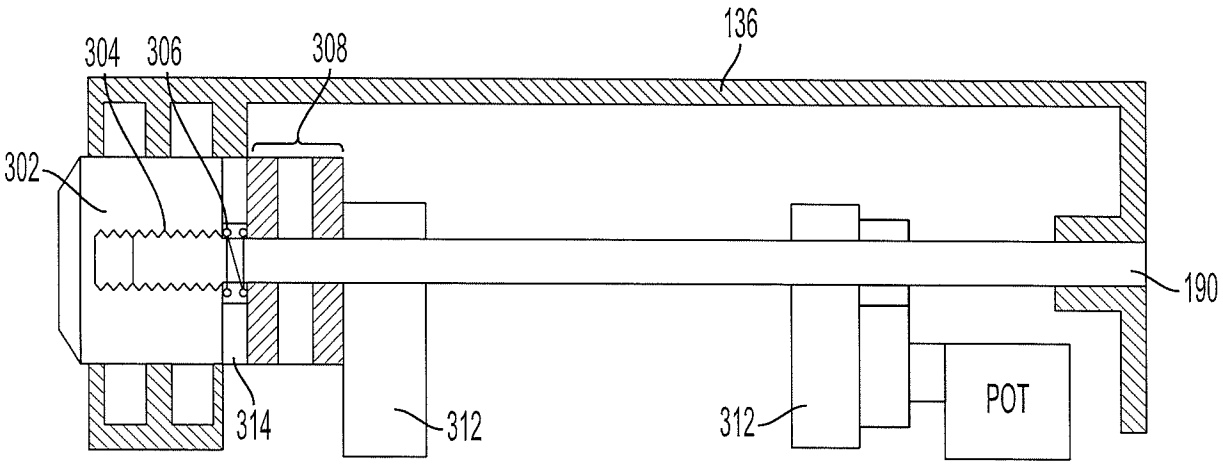
Figure 10:
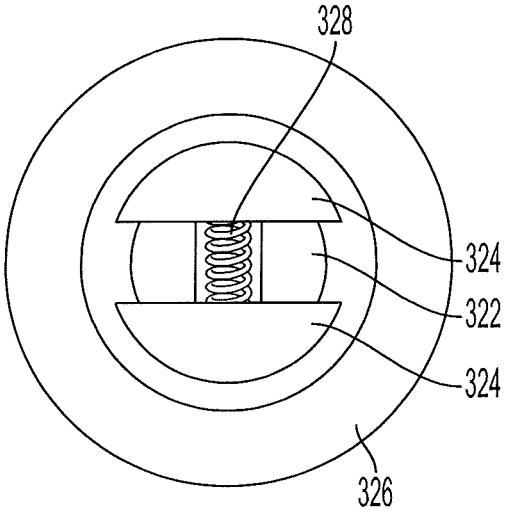
Figure 11:
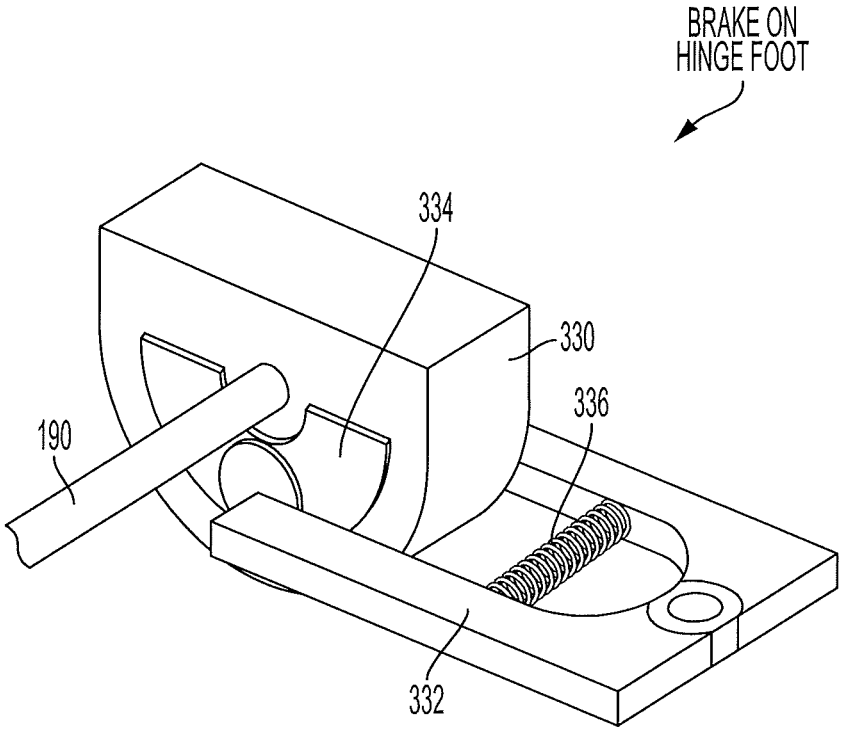
Figure 12:
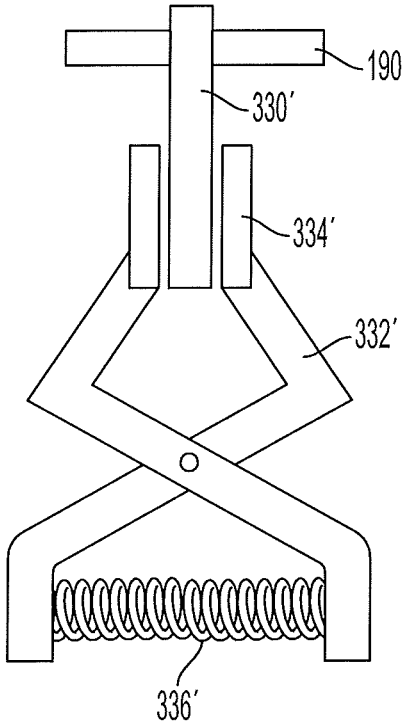
Figure 13:
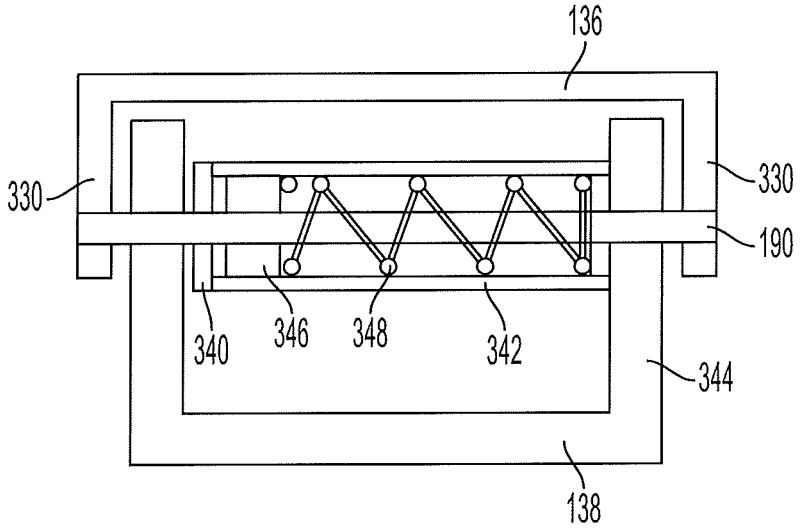
Figure 14:
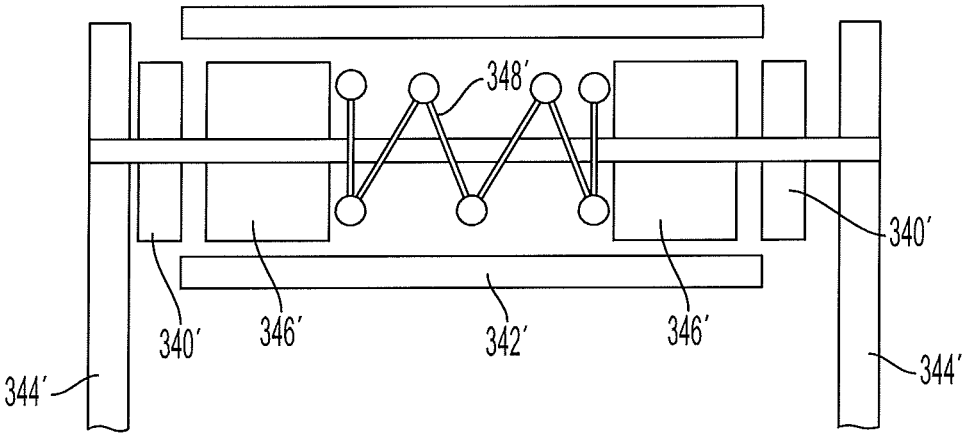
Figure 15:
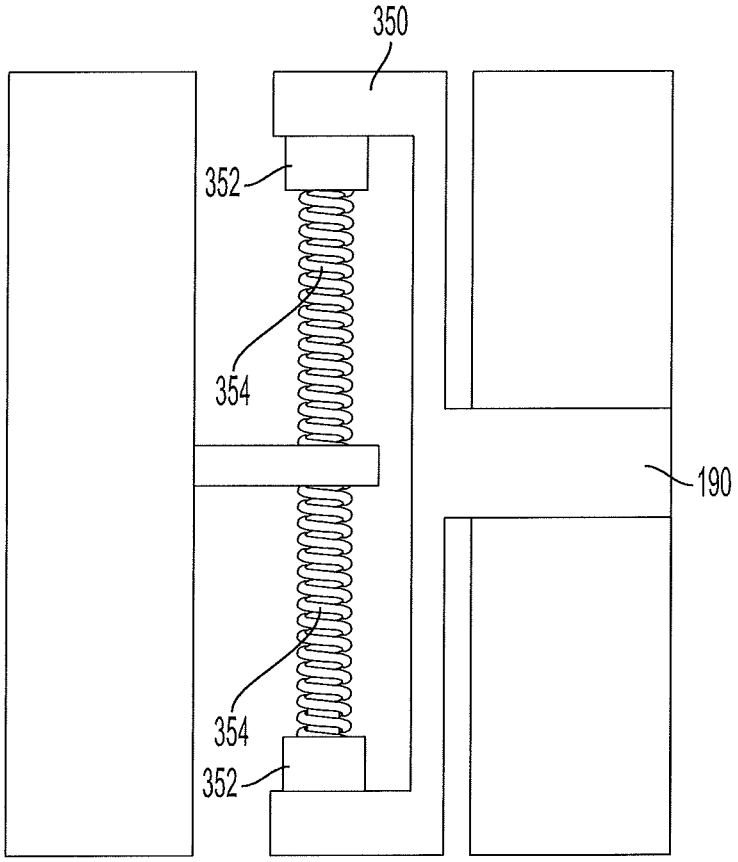
Figure 16:
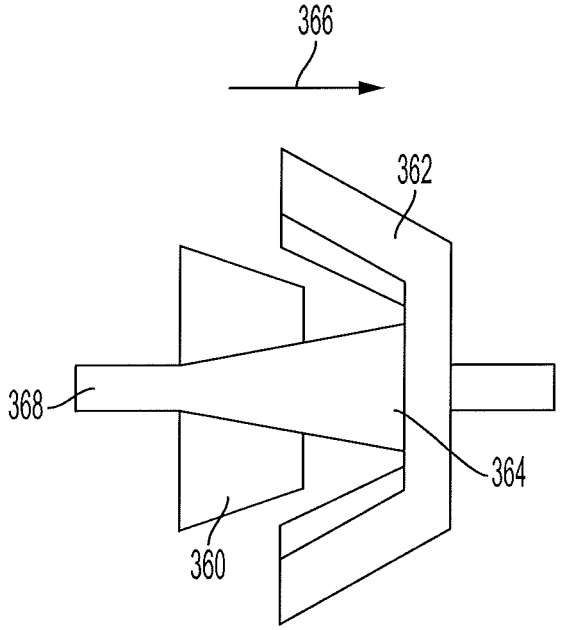
Figure 17:
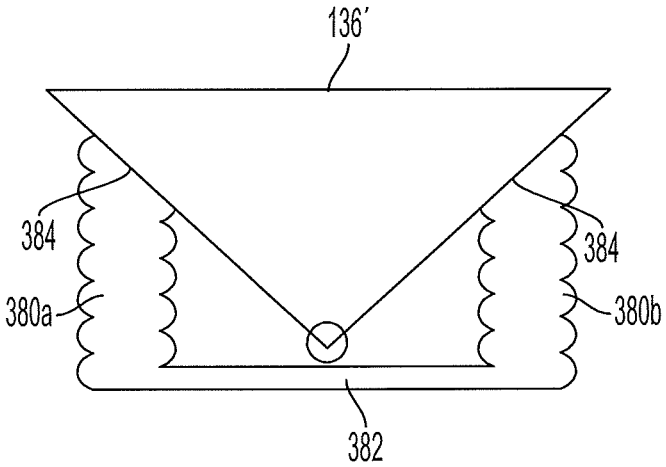
Figure 18:
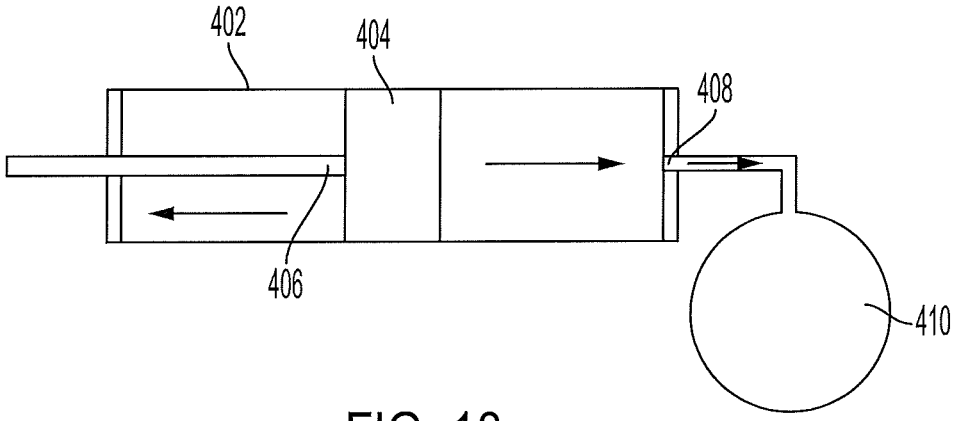
Figure 19:
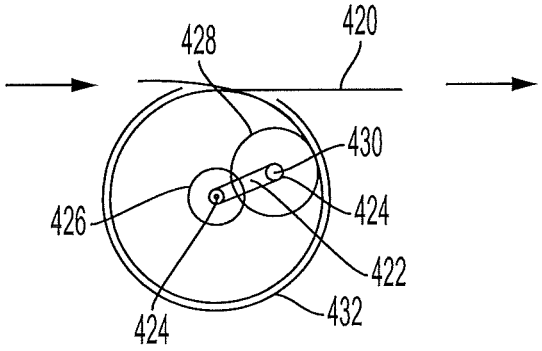
Figure 20:
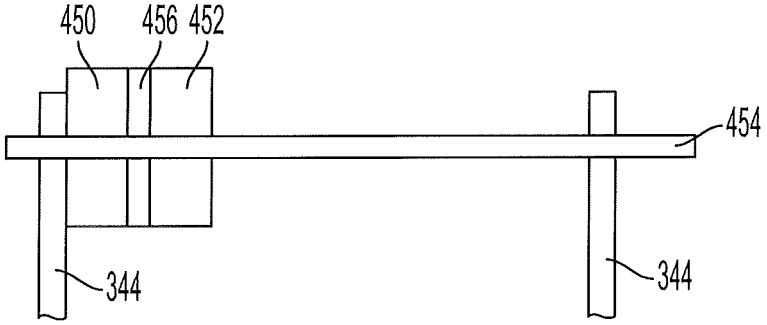
Figure 21:
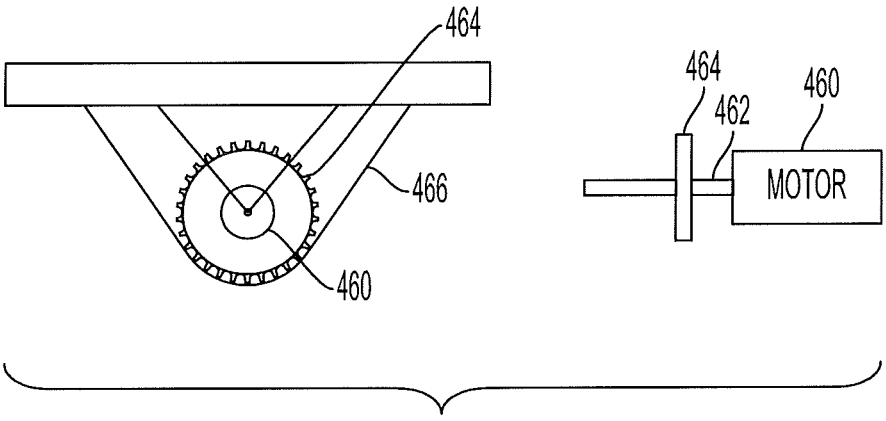
Figure 22:
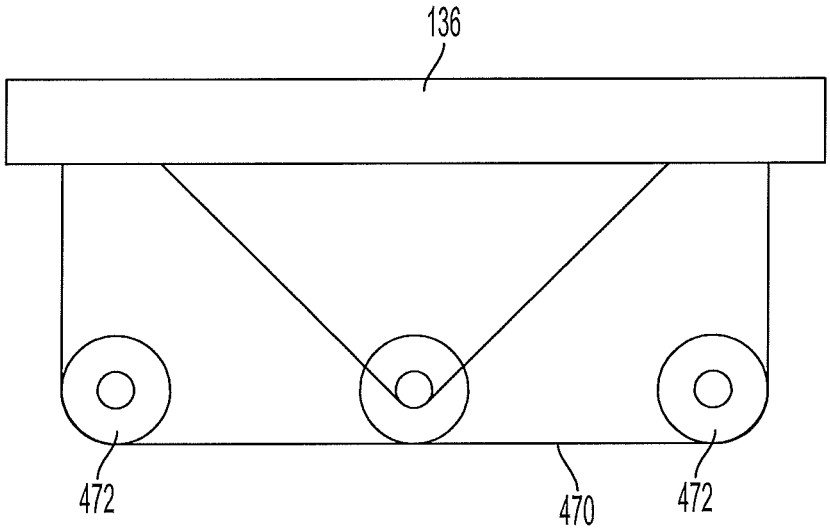
Figure 23:
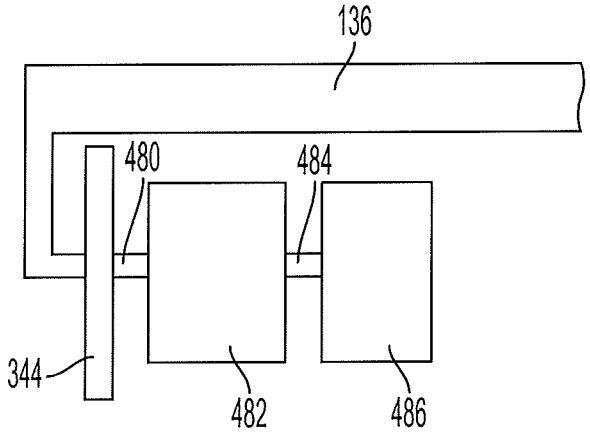
Figure 24A:
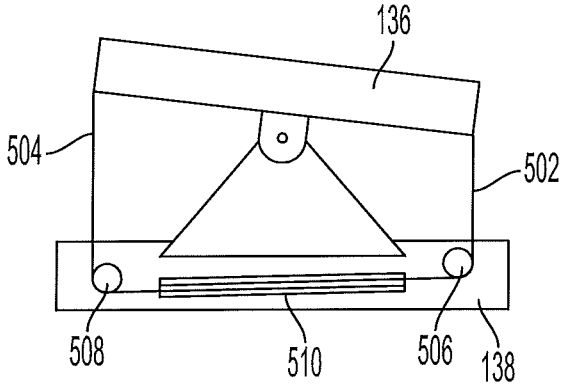
Figure 24B:
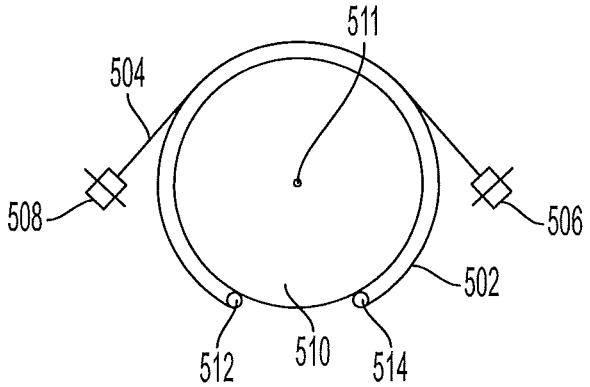
Figure 25:
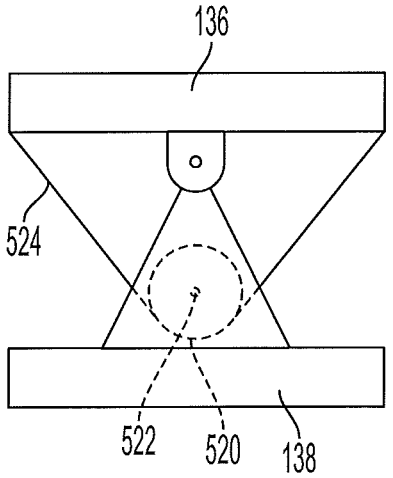
Figure 26:
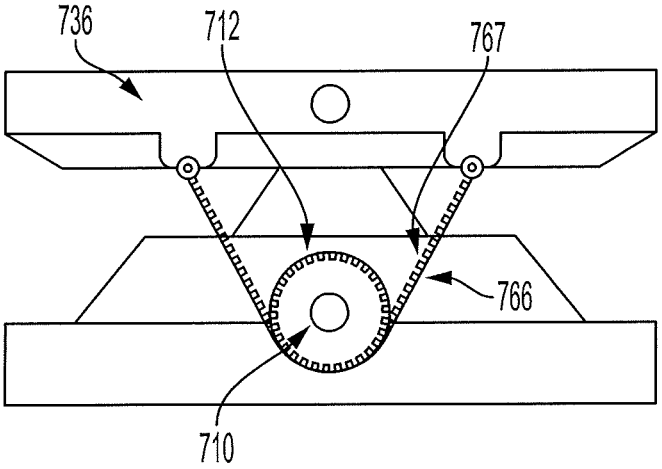
Figure 27:
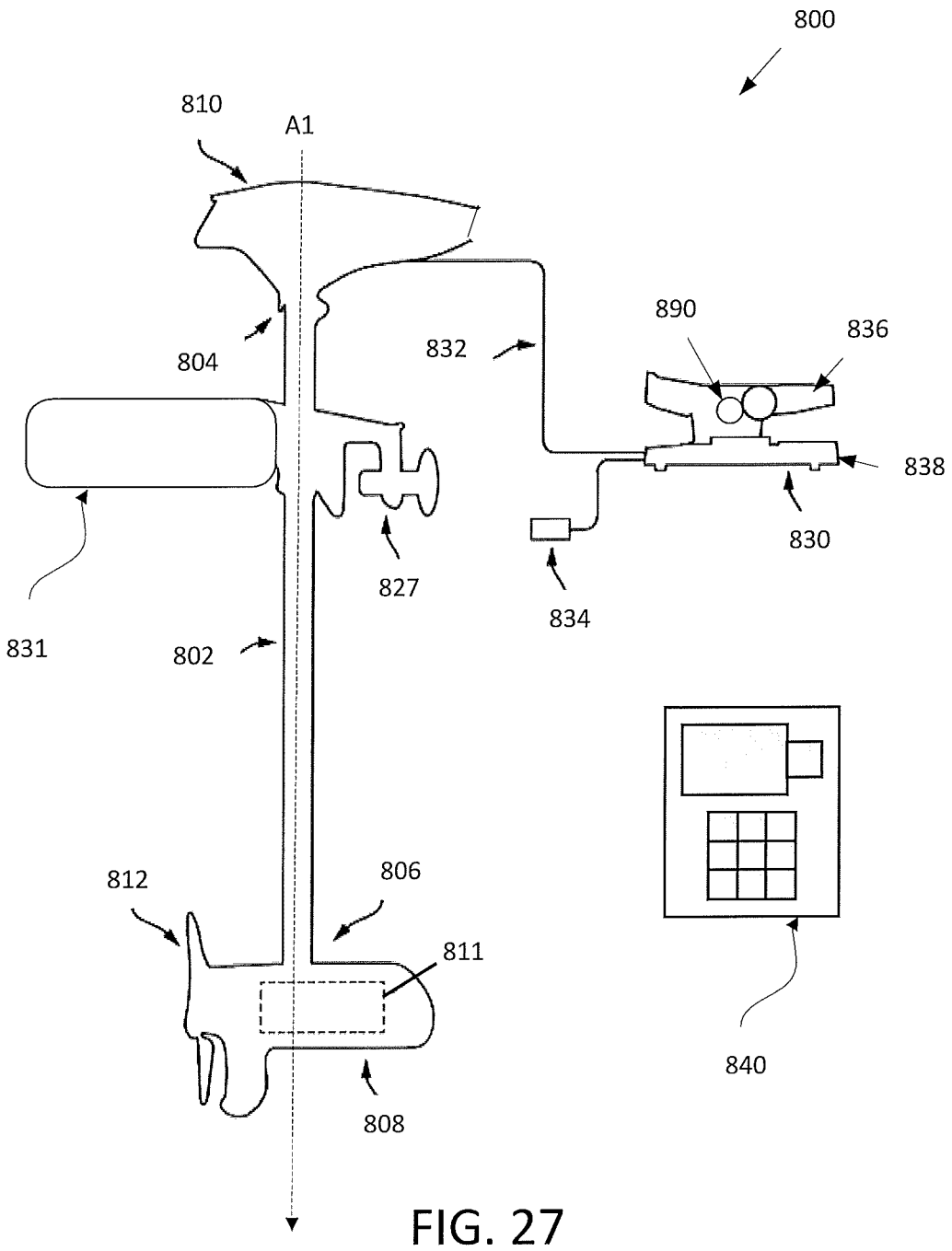
Figure 28:
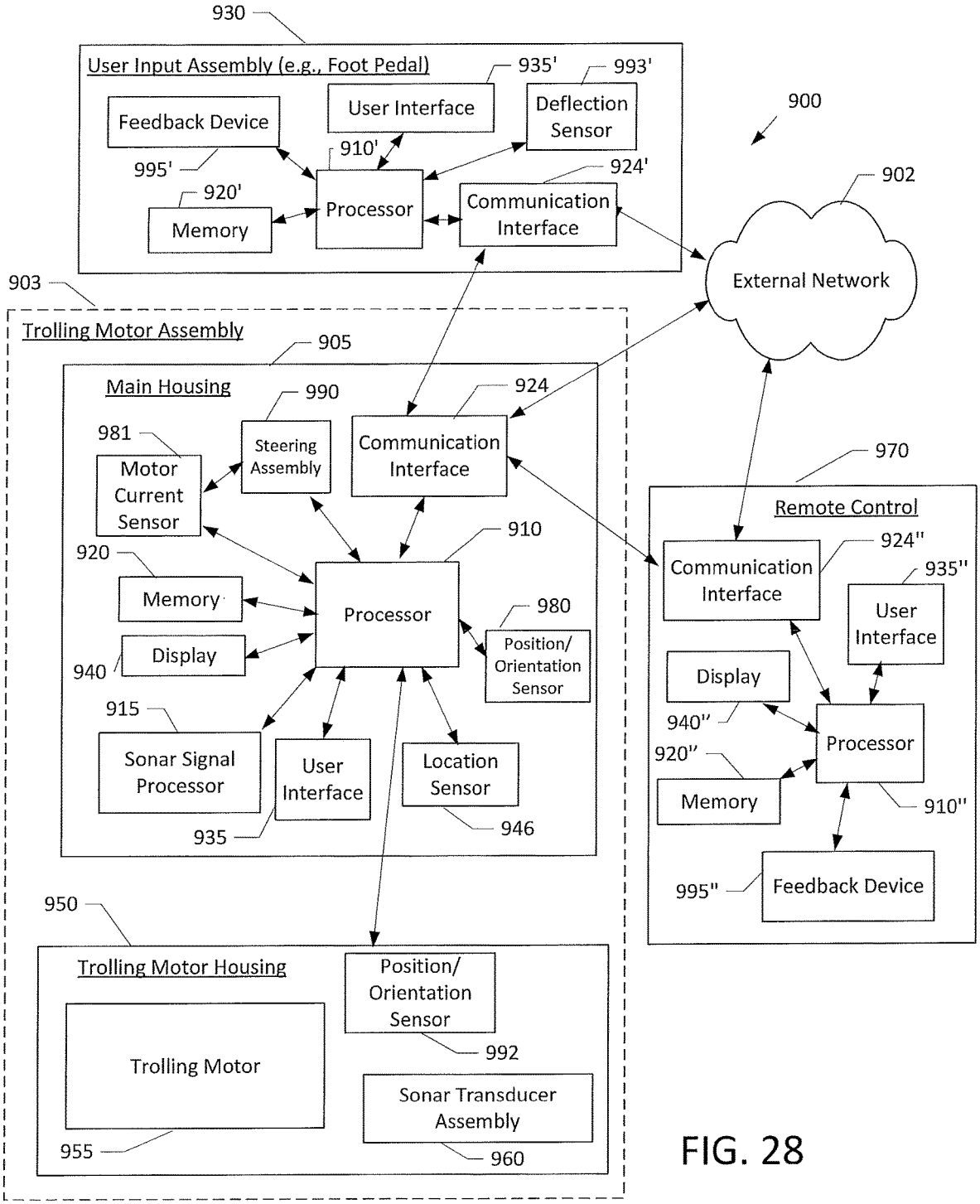
Figure 29:
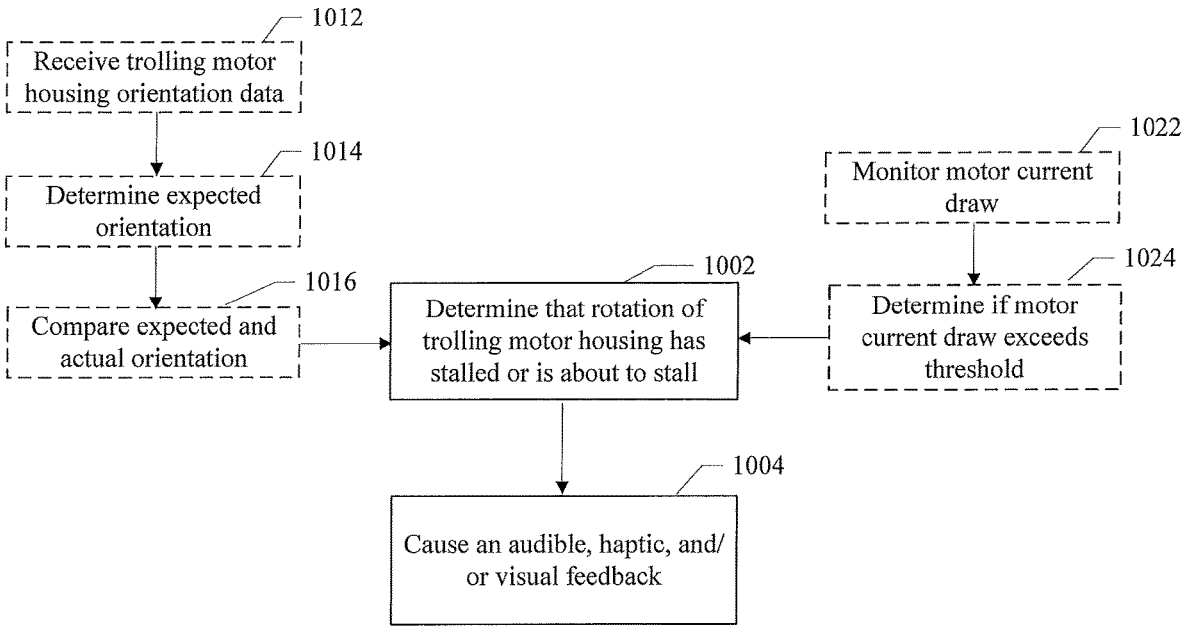

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 shows an example trolling motor assembly, in accordance with some embodiments discussed herein;

FIG. 3 shows a top view of an example foot pedal assembly, in accordance with some embodiments discussed herein;

FIG. 4 shows a perspective view of the example foot pedal assembly for a trolling motor assembly as shown in FIG. 3, in accordance with some embodiments discussed herein;

FIG. 5 shows a perspective view of an example support plate and shaft of the example foot pedal assembly shown in FIG. 4, in accordance with some embodiments discussed herein;

FIG. 6 shows an underside perspective view of an example foot pedal and second shaft of the example foot pedal assembly shown in FIGS. 3-4, in accordance with some embodiments discussed herein;

FIG. 7 shows a block diagram illustrating an example system of a trolling motor assembly and a navigation control device, in accordance with some embodiments discussed herein;

FIG. 8 illustrates a simplified cross section showing some components of an example foot pedal assembly having a drag washer for providing a feedback resistance to pivotal foot pedal movement, in accordance with some embodiments discussed herein;

FIG. 9 illustrates a simplified cross section showing some components of another example foot pedal assembly having a drag washer for providing a feedback resistance to pivotal foot pedal movement, in accordance with some embodiments discussed herein;

FIG. 10 illustrates a schematic of an example clutch brake for providing a feedback resistance to pivotal foot pedal movement, in accordance with some embodiments discussed herein;

FIG. 11 illustrates some components of an example brake assembly for providing a feedback resistance to pivotal foot pedal movement, in accordance with some embodiments discussed herein;

FIG. 12 illustrates some components of an alternative example brake assembly for providing a feedback resistance to pivotal foot pedal movement, in accordance with some embodiments discussed herein;

FIG. 13 illustrates a simplified cross section showing some components of an example foot pedal assembly having a brake pad for providing a feedback resistance to pivotal foot pedal movement, in accordance with some embodiments discussed herein;

FIG. 14 illustrates a simplified cross section showing some components of an example foot pedal assembly having a pair of brake pads for providing a feedback resistance to pivotal foot pedal movement, in accordance with some embodiments discussed herein;

FIG. 15 illustrates a simplified cross section of some components of an example drum brake assembly for providing a feedback resistance to pivotal foot pedal movement, in accordance with some embodiments discussed herein;

FIG. 16 illustrates a simplified cross section of some components of an example tapered brake assembly for providing a feedback resistance to pivotal foot pedal movement, in accordance with some embodiments discussed herein;

FIG. 17 illustrates a schematic of an example bellows brake assembly for providing a feedback resistance to pivotal foot pedal movement, in accordance with some embodiments discussed herein;

FIG. 18 illustrates a schematic of an example linear cylinder and piston for providing a feedback resistance to pivotal foot pedal movement, in accordance with some embodiments discussed herein;

FIG. 19 illustrates a schematic of an example peristaltic pump for providing a feedback resistance to pivotal foot pedal movement, in accordance with some embodiments discussed herein;

FIG. 20 illustrates a simplified cross section of some components of an example magnetic brake assembly for providing a feedback resistance to pivotal foot pedal movement, in accordance with some embodiments discussed herein;

FIG. 21 illustrates a schematic of an example motor assembly for providing a feedback resistance to pivotal foot pedal movement, in accordance with some embodiments discussed herein;

FIG. 22 illustrates a schematic of an example foot pedal coupled with a friction pulley assembly for providing a feedback resistance to pivotal foot pedal movement, in accordance with some embodiments discussed herein;

FIG. 23 illustrates a schematic of an example flywheel assembly for providing a feedback resistance to pivotal foot pedal movement, in accordance with some embodiments discussed herein;

FIGS. 24A-B illustrate a schematic of another example flywheel assembly for providing a feedback resistance to pivotal foot pedal movement, in accordance with some embodiments discussed herein;

FIG. 25 illustrates a schematic of another example flywheel assembly for providing a feedback resistance to pivotal foot pedal movement, in accordance with some embodiments discussed herein;

FIG. 26 illustrates a schematic of another example feedback device, in accordance with some embodiments discussed herein;

FIG. 27 shows an example trolling motor assembly, in accordance with some embodiments discussed herein;

FIG. 28 shows a block diagram illustrating a marine system including an example trolling motor assembly, user input assembly, and remote control, in accordance with some embodiments discussed herein; and FIG. 29 illustrates a flowchart of an example method for causing haptic, audible, or visual feedback in response to determining that the rotation of the direction of the trolling motor housing has stalled or is about to stall, in accordance with some embodiments discussed herein.

DETAILED DESCRIPTION

Exemplary embodiments of the present invention now will be described more fully hereinafter with reference to the accompanying drawings, in which some, but not all, embodiments of the invention are shown. Indeed, the invention may be embodied in many different forms and should not be construed as limited to the exemplary embodiments set forth herein. Rather, these embodiments are provided so that this disclosure will satisfy applicable legal requirements. Like reference numerals refer to like elements throughout.

Some foot pedal assemblies for controlling the operation of trolling motors provide an electrical signal based on a foot pedal position to electronically steer the trolling motor. The electrical signal is provided to a controller that, in turn, controls an actuator that articulates the trolling motor's position/direction and, thus, propulsion direction. This contrasts with a traditional, mechanical style in which movement of a pedal pulls mechanical cables that manually articulate the trolling motor's position/direction and, thus, propulsion direction. The traditional style provides a resistance to movement, as the user has to provide enough torque to physically rotate the trolling motor. The electronically steered foot pedal assemblies do not provide such as resistance force. It may be desirable, however, for some users to feel the resistance as a form of feedback for the user. Thus, some embodiments of the present disclosure provide feedback resistance in response to a user adjusting the foot pedal position.

Some existing foot pedals for controlling the operation of trolling motors have buttons attached to a fixed, non-pivotable support plate that communicate with a controller. However, depending on the angle of the foot pedal, in some foot pedal positions, such buttons may be difficult to reach, while in other foot pedal positions, such buttons may subject to accidental actuation. Thus, some embodiments of the present disclosure seek to provide a foot pedal with buttons that are properly accessible independent of the foot pedal position and, in some cases, are disposed on the rotating part of the foot pedal assembly (thereby providing for easy access by a user).

FIG. 1 illustrates an example watercraft 10 on a body of water 15. The watercraft 10 has a trolling motor assembly 20 attached to its front, with a propulsion motor 50 submerged in the body of water. According to some example embodiments, the trolling motor assembly 20 may include the propulsion motor 50, a propeller 52, and a navigation control device used to control the speed and the course or direction of propulsion. The trolling motor assembly 20 may be attached to the bow of the watercraft 10 and the propulsion motor 50 and propeller 52 may be submerged in the body of water. However, positioning of the trolling motor assembly 20 need not be limited to the bow and may be placed elsewhere on the watercraft 10. The trolling motor assembly 20 can be used to propel the watercraft 10, such as when fishing and/or when wanting to remain in a particular location despite the effects of wind and currents on the watercraft 10. Depending on the design, the propeller 52 of a trolling motor assembly may be driven by a gas-powered engine or an electric motor. Moreover, steering the trolling motor assembly 20 may be accomplished manually via hand control or via foot control or electronically using a remote and/or foot pedal. While FIG. 1 depicts the trolling motor assembly 20 as being a secondary propulsion system to the main engine 11, example embodiments described herein contemplate that the trolling motor assembly 20 may be the primary propulsion system for the watercraft 10.

FIG. 2 illustrates an example trolling motor assembly 100 that is electric and may be controlled with a foot pedal assembly 130. The trolling motor assembly 100 includes a shaft 102 defining a first end 104 and a second end 106, a trolling motor housing 108 and a main housing 110. The trolling motor housing 108 is attached to the second end 106 of the shaft 102 and at least partially contains a propulsion motor 111, or trolling motor, that connects to a propeller 112. As shown in FIG. 1, in some embodiments, when the trolling motor assembly is attached to the watercraft 10 and the propulsion motor 111 (or trolling motor housing) is submerged in the water, the propulsion motor is configured to propel the watercraft to travel along the body of water. In addition to containing the propulsion motor 111, the trolling motor housing 108 may include other components such as, for example, a sonar transducer assembly and/or other sensors or features (e.g., lights, temperature sensors, etc.).

The main housing 110 is connected to the shaft 102 proximate the first end 104 of the shaft 102 and may, in some embodiments, include a hand control rod (not shown) that enables control of the propulsion motor 111 by a user (e.g., through angular rotation) although the foot pedal assembly 130 is the preferred method of controlling the operation of the trolling motor assembly 100 for various embodiments described herein. As shown in FIG. 1, in some embodiments, when the trolling motor assembly is attached to the watercraft and the propulsion motor 111 is submerged in the water, the main housing 110 is positioned out of the body of water and visible/accessible to a user. The main housing 110 may be configured to house components of the trolling motor assembly, such as may be used for processing marine data and/or controlling operation of the trolling motor, among other things. For example, with reference to FIG. 7, depending on the configuration and features of the trolling motor assembly, the trolling motor assembly 100 may contain, for example, one or more of a processor 116, sonar assembly 118, memory 120, communication interface 124, an autopilot navigation assembly 126, a speed actuator 128, and a steering actuator 129 for the propulsion motor 111. In some embodiments, a controller 115 may comprise the processor 116, memory 120, communications interface 124, and the autopilot navigation assembly 126.

Referring back to FIG. 2, as noted, in some embodiments, the trolling motor assembly 100 includes a foot pedal assembly 130 that is electrically connected to the propulsion motor 111 (such as through the main housing 110) using a cable 132 (although wireless communication is also contemplated). Referring also to FIG. 7, the foot pedal assembly 130 may enable a user to steer and/or otherwise operate the trolling motor assembly 100 to control the direction and speed of travel of the watercraft. Further, depending on the configuration of the foot pedal assembly, the foot pedal assembly 130 may include an electrical plug 134 that can be connected to an external power source.

The trolling motor assembly 100 may also include an attachment device (e.g., a clamp, a mount, or a plurality of fasteners) to enable connection or attachment of the trolling motor assembly 100 to the watercraft. Depending on the attachment device used, the trolling motor assembly 100 may be configured for rotational movement relative to the watercraft, including, for example, 360 degree rotational movement.

FIGS. 3 through 6 show an example implementation of a user input assembly of a navigation control device according to various example embodiments in the form of a foot pedal assembly 130. The foot pedal assembly 130 may be one example of a user input assembly that, in some embodiments, includes a switch in the form of a pressure sensor 143 (FIG. 7) operated by a depressable momentary button 142 and/or a pivotable foot pedal 136 (although in some embodiments, there may be no pressure sensor within the foot pedal assembly). In further embodiments, the foot pedal assembly may include buttons 600 that depend from the pedal adjacent the pedal's upper surface.

The foot pedal assembly 130 may be in operable communication with the trolling motor assembly 100 (FIG. 2), via, for example, the processor 180 as described with respect to FIG. 7. The foot pedal assembly 130 includes a lever in the form of the foot pedal 136 that can pivot about a horizontal axis in response to movement of, for example, a user's foot. The foot pedal assembly 130 further includes a support plate 138 and a deflection sensor 182 (see also FIG. 7). As described herein, the deflection sensor 182 may measure the deflection of the foot pedal 136 and provide an indication of the deflection to, for example, the processor 180. Such deflection may be used to control the rotation of the trolling motor shaft (e.g., the direction/orientation of the trolling motor) and, in some embodiments, in conjunction with a feedback device that provides resistance feedback to a user to simulate a reactionary force to a user utilizing the foot pedal.

In some embodiments, a speed input device 197 (e.g., the dial 197 shown in FIG. 3) may be provided to enable a user to set the speed at which the trolling motor propels the boat. Based on the setting of the speed input device, a corresponding speed signal may be provided to the speed actuator 128 via a wired or wireless connection.

In some embodiments, the foot pedal assembly may include a momentary switch 144 (FIG. 7) that may, in some embodiments, form an ON/OFF button to selectively provide power to the foot pedal assembly 130.

Referring to FIG. 5, the foot pedal 136 may be rotationally fixed to a first shaft 190 so that the rotation of the pedal causes corresponding rotation of the first shaft about an axis 191. As used herein, "rotationally fixed" refers to a coupling in which rotationally fixed components pivot about the same axis and for the same angular displacement. The first shaft 190 may pivot within housings 192 of support plate 138. A first gear 194 is keyed to the shaft 190 so that it is rotationally fixed with the shaft, and therefore, the foot pedal 136. Teeth of the first gear 194 engage a second gear 196 that is rotationally fixed to a second shaft 198. Accordingly, as the pedal pivots, it causes the second shaft 198, via the first and second gears 194, 196, to rotate.

Some embodiments of the present invention include a deflection sensor for determining the angle of orientation/deflection of the foot pedal. In the depicted embodiment of FIG. 6, a magnet (not shown) may be disposed within a first end of shaft 198 that is adjacent the deflection sensor 182, which may be, for example, a Hall effect sensor. Such an example deflection sensor 182 may continuously detect the orientation of the magnet, and, thus, the orientation of the shaft 198, which corresponds with the pedal's deflection angle. In further embodiments, the shaft 198 physically and rotationally couples with the deflection sensor 182, which may be, for example, a Hall effect sensor, a potentiometer, a RVDT sensor, an inductive position sensor, or a rotary encoder. In yet further embodiments, the deflection sensor may directly measure the deflection angle of the first shaft 190, rather than indirectly measuring the deflection angle by measuring the deflection of a second shaft that is coupled with the first shaft and correlating the second shaft's angle with the first shaft's angle.

In the illustrated embodiment, the first gear 194 has a larger diameter than the second gear 196, thereby providing a gear ratio that is greater than 1:1. The gear ratio of the first gear 194 to the second gear 196 may be selected in order to optimize the resolution of the deflection sensor. That is, because of said gear ratio, small changes in pedal deflection angle correspond to large changes in the second shaft's deflection angle, which may utilize a greater span of the deflection sensor's sensing range than a lower gear ratio.

Referring also to FIG. 7, according to some example embodiments, the measured deflection of the foot pedal 136 may be an indication of a desired propulsion direction for the propulsion motor. In this regard, a user may cause the foot pedal 136 to rotate or deflect; and rotation of the foot pedal 136 in the counterclockwise direction (such that the left side of the illustrated foot pedal in FIG. 2 is tilted down) may cause the propulsion direction to turn to the left while rotation of the foot pedal 136 in the clockwise direction (such that the right side of the illustrated foot pedal in FIG. 2 is tilted down) may cause the propulsion direction to turn to the right. The deflection sensor 182, which may be attached to a printed circuit board 200, may provide a signal corresponding with a deflection angle to a controller 179 (which may include the processor 180, the memory 184, and the communications interface 186). As further discussed herein, the detected foot pedal deflection angle may cause the trolling motor's steering actuator 129 to pivot about the shaft 102, thereby causing the propeller 112 (FIG. 2), if ON, to propel the watercraft in a desired direction. That is, a motor (e.g., a stepper motor) may cause the shaft 102 to pivot about its axis in order to position the propeller 112 in a desired orientation that a user sets via the foot pedal deflection angle.

Some embodiments of the present invention provide a foot pedal assembly configured for electrically and remotely controlling a trolling motor assembly. In traditional pedal-steered trolling motors, pivoting of the pedal manually pivots the trolling motor via a direct cable connection. Such cable-steered trolling motors provide a feedback resistance "feel" that may be preferable for some users. Accordingly, it may be desirable to provide electrically steered motors having a foot pedal resistance that simulates resistance of mechanically moving the trolling motor. Some embodiments disclosed herein implement systems for providing such a feedback resistance. For example, the foot pedal may include various features, such as, but not limited to, flywheels, brakes, and various other elements that resist rotational acceleration of the pedal as it pivots about its axis.

In the illustrated embodiment of FIG. 6, a rotary damper 210 couples with the second shaft 198 at a second end, opposite the first end. The rotary damper 210 may resist rotational motion. Accordingly, the second gear 196 may act as a damper gear that resists motion of the shaft 198, and, accordingly, all other components mechanically and rotationally coupled thereto, including the pedal 136. In some embodiments, the damper resists rotational motion as a function of its angular speed. For example, the rotary damper 210 may provide a resistive force that is proportional to the rate at which the foot pedal pivots. Because of the gear ratio between first gear 194 and second gear 196, an angular speed of the pedal 136 causes an angular speed of the damper gear that is higher than that of the pedal 136. For this reason, when using a damper that increases resistance with angular speed, the second gear's stepped-up pivotal movement provides a corresponding increased resistance to the angular speed of the pedal. In other embodiments, the damper's resistive torque is constant across a range of angular speeds. In some embodiments, the resistive torque remains consistent for a given angular speed. Further, in some embodiments, the resistive torque remains consistent for a given angular speed over a number of cycles. Alternatively, in some embodiments, the resistive force may remain consistent over the life of the product.

FIGS. 8-25 illustrate various other example embodiments for providing resistive feedback to changes in the foot pedal's angular position. In this regard, some of the example embodiments provide feedback devices that simulate the resistance of a traditional trolling motor pedal that moves the trolling motor via mechanical cables.

Referring to FIG. 8, the pedal 136 may couple with the shaft 190 via feet 310*a*, 310*b* so that the foot pedal is rotationally fixed to the shaft. A drag washer 308 may be disposed between a first shaft housing 312, which is rigidly coupled to the support plate 138, and one foot 310*a* of the pedal 136. A nut 302 may be tightened down on threads 304 of the first shaft 190, thereby compressing the drag washer 308 between the foot 310*a* of the pedal 136 and the first shaft housing 312. The first shaft housing 312 may, in some embodiments, be the same as, or similar to, the housings 192 as shown in FIG. 5. Drag washer 308 may comprise a fiber washer 308B disposed between two metal washers 308A. As the nut 302 is tightened down, the drag washer is compressed between the foot 310*a* and the first shaft housing 312. Because the foot 310*a* of the pedal 136 pivots as the pedal pivots, while the first shaft housing 312 does not, respective pivotal movement between the pedal and the housing creates friction at the interfaces between all of the respective components. Specifically, the fiber and metal layers may be selected to provide desired interfaces that cause a lower static frictional force than interfaces between other material interfaces (e.g., the interface between the washer 308 and the foot 310*a* of the pedal 136 and the interface between the washer 308 and the first shaft housing 312 of the support plate 138). In this way, sliding may occur only at interfaces between the fiber and metal washers in response to pivotal movement of the pedal. Nut 302 may be adjusted to change the force on the drag washers, thereby adjusting the frictional resistive torque.

Referring to FIG. 9, another example embodiment implementing drag washers is shown. A spring 306 is disposed between the nut 302 and the drag washer 308 and within a hollow cylindrical spacer 314. As the nut 302 is tightened down, the spring 306 increases its compressive force, thereby compressing the drag washer 308. Accordingly, the drag washer resistively allows pivoting between the spring 306 and the first shaft housing 312.

Referring to FIG. 10, a clutch brake may be implemented to resist the foot pedal's rotational movement. In some embodiments, a pair of brake shoes 324 may be affixed to a shaft 322 so that the brake shoes may move radially from the shaft's axis. Rotation of the shaft 322 causes a centrifugal force on the brake shoes, thereby forcing them radially outward from the shaft's axis and against a drum 326. The drum 326 may be fixed to the support plate 138 (FIG. 3) so that it does not pivot. Accordingly, as the brake shoes 324 engage the drum, the frictional force between the respective components resists the rotation of the brake shoes 324 and, thus, the shaft 322. An increase in angular velocity corresponds with an increase in centrifugal force and, therefore, an increased frictional force, thereby causing an increasing resistive force as the angular velocity of the shaft 322 increases. The shaft 322 may be coupled to the first shaft 190 (FIG. 5) by a gear train so that a small angle of rotation of the shaft 190 causes a relatively larger angle of rotation of the shaft 322, thereby corresponding with faster rotation of the shaft 322 than the first shaft 190.

FIGS. 11-12 illustrate alternative example embodiments of a foot pedal having a brake to resist the pedal's pivotal movement. The foot pedal 136 (FIG. 3) may include a pair of feet 330, 330' (one foot shown) that engage the shaft 190 (FIG. 5), a similar embodiment of which is described with reference to FIG. 8. A caliper 332, 332' may hold a pair of brake pads 334, 334' against one foot 330, 330' of pedal 136. A spring 336, 336' may provide tension on the caliper to bias the brake pads 334, 334' against the foot 330, 330'. The caliper 332, 332' may be fixed to the support plate 138 (FIG. 3) so that as the pedal and, accordingly, the foot 330, 330', pivot about the shaft's axis, the brake pads slide against side faces of the foot 330, 330', thereby resisting pivotal movement of the pedal.

Referring to FIG. 13, the foot pedal assembly may include a brake pad 340 that slides along the axis of the shaft 190 adjacent a hollow cylindrical housing 342. The support plate 138 may include a pair of housings 344 that support the shaft 190. A spacer 346 is slidably disposed at one end of a spring 348 within the housing 342 and biases against the brake pad 340 so that the brake pad 340 biases against one of housings 344. Foot pedal 136 is rotationally fixed to shaft 190 at feet 330, and brake pad 340 is rotationally fixed to the shaft 190. Accordingly, rotation of the pedal causes rotation of the brake pad 340, yet the housing 344 is stationary, thereby causing sliding friction at the interface between the brake pad 340 and the housing 344.

FIG. 14 illustrates a similar embodiment as in that of FIG. 13 but utilizes two brake pads 340'. The spring 348' biases against two opposing spacers 346' that, in turn, bias against respective brake pads 340'. The brake pads 340' engage respective housings 344' to resist rotation between the pedal 136 (FIG. 4) and the support plate 138 (FIG. 5).

FIG. 15 illustrates an example drum brake that may be implemented to resist respective rotation between the pedal and the support plate. A brake drum 350 may be rotationally fixed to the shaft 190. A pair of drum shoes 352 may be fixed to the support plate 138 (FIG. 5) and bias under respective spring force of springs 354 against the brake drum 350 to resist respective rotation between the foot pedal and the support plate.

Referring to FIG. 16, an example tapered acceleration drum brake may be implemented to resist respective rotation between the pedal and the support plate. A tapered brake shoe 360 is rotationally fixed to the shaft 368. As the angular speed of the shaft increases, the tapered brake shoe 360 undergoes a centrifugal force. The shaft 368 includes a tapered end 364 that increases in diameter in an axial direction 366. Accordingly, a centripetal force causes the tapered brake shoe 360 to slide axially along the shaft 368 in the direction 366 toward a tapered drum 362. The tapered drum 362 is fixed with respect to the support plate (FIG. 5), and engagement with the tapered brake shoe 360 causes a frictional force that resists movement of the brake shoe, and therefore, the shaft's motion. In this way, an increasing angular shaft speed causes a correspondingly increasing force between the tapered brake shoe 360 and the tapered drum 362, thereby providing an increasing resistive feedback. In some embodiments, the shaft 368 may be connected to the shaft 190 (FIG. 5) via a gear train that causes a greater angular speed in the shaft 368 than that of the shaft 190.

Referring to FIG. 17, in some embodiments, a pedal 136' may include a pair of flexible, fluid-filled baffles 380*a*, 380*b* connected by a restricted pathway 382. In some embodiments, the baffles 380*a*, 380*b* may be filled with a viscous fluid. In further embodiments, the baffles may be filled with air. The pedal may have surfaces 384 that engage respective baffles 380. As the pedal pivots, one of the engagement surfaces 384 may press against its respective baffle 380*a*, thereby compressing the baffle and increasing pressure in its volume. Accordingly, this pressure increase causes the fluid to flow through the restricted pathway 382 and into the other baffle 380*b*. The restricted pathway 382 resists such fluid movement and, therefore, resists pivotal motion of pedal 136' about its pivotal axis.

Referring to FIG. 18, some example embodiments of a foot pedal assembly in accordance with the present disclosure may include a linear cylinder 402 (which may be pneumatic or hydraulic) that has a piston 404 therein. The piston 404 may connect to a shaft 406. The shaft may connect to one of the foot pedal 138 (FIG. 3) or the support plate 138 (FIG. 3), and the cylinder 402 may connect to the other of the foot pedal or the support plate. At least one of the cylinder and the shaft may connect via a rotational to linear motion mechanism, such as, for example, a slider coupled with a crank. In this way, as the foot pedal pivots with respect to the support plate, the shaft 406 drives the piston 404 linearly within the cylinder 402. The cylinder may include an orifice 408 through which air or hydraulic fluid may pass. The orifice 408 may be of a select size so that movement of the piston provides a desired resistance. Some embodiments may further include a reservoir 410 outside the piston into and from which hydraulic fluid may be pumped.

Referring to FIG. 19, some embodiments of a foot pedal assembly in accordance with the present disclosure may include a peristaltic pump for resisting pivotal motion of the foot pedal. The peristaltic pump may include a tubing 420 full of a viscous liquid and that is formed in a loop in a housing 432. The pump may include a crank arm 422 driven about an axis 424. The crank arm may, for example, rigidly connect to a shaft 426. The foot pedal 136 (FIG. 3) may drive the shaft 426 via a gear train that is configured so that the shaft 426 rotates faster than the pedal pivots about its axis. A pivoting wheel 428 may pivot about an end of the crank atm 422 opposite the shaft 424 about an axis 430. As the wheel 428 rotates, it pinches the tubing 420 against the housing 432, thereby displacing fluid in the tubing in the direction in which the crank arm 422 rotates. The liquid's viscosity resists such flow, thereby resisting movement of the crank arm 422, and, consequently, via the mechanical couplings, the foot pedal.

Referring to FIG. 20, some embodiments of a foot pedal assembly may include a magnetic brake for resisting pivotal motion of the foot pedal. A magnet 450 may be fixed to one of a pair of housings 344 that support a shaft 454 so that the magnet does not rotate. A steel plate 452 may be positioned proximate the magnet and rotationally fixed to the shaft 454. A PTFE washer 456 may be disposed between the magnet 450 and the steel plate 452. The foot pedal may be coupled with the shaft 454 so that, when the foot pedal pivots, the shaft rotates. In some embodiments, the foot pedal couples with the shaft 454 via a gear train that causes the shaft 454 to rotate proportionally faster than the pedal. As the pedal pivots, the shaft and steel plate correspondingly rotate. Because of the respective movement between the steel plate and the magnet, the magnet causes eddy currents that create a magnetic field opposite the magnet's magnetic field, thereby resisting the direction of motion of the steel plate and shaft. Accordingly, the steel plate and magnet act as a magnetic brake.

Referring to FIG. 21, the foot pedal assembly may include a motor 460 that drives a shaft 462 having a sprocket 464 keyed thereto so that the sprocket and shaft are rotationally fixed. The pedal 136 may couple at each end with a chain 466 that runs along the sprocket 464 so that as the pedal turns, the sprocket turns. A controller (not shown) may detect motion of the pedal. In response thereto, the controller may provide a signal to the motor that causes the motor to provide a torque in a direction opposite the sprocket's pivotal direction.

Referring to FIG. 22, another example feedback device is shown. In the depicted embodiment, the ends of the pedal 136 may be coupled with a cable 470. The cable drives at least one friction wheel 472. The friction wheels may resist rotation, thereby resisting movement of cable 470 and, therefore, pedal 136.

In some embodiments, the foot pedal may couple with a flywheel, such that the flywheel may provide resistance force. FIG. 23 illustrates an example flywheel-based feedback device. In the depicted embodiment, the pedal 136 may be rotationally fixed, via a shaft 480, to a gear in a gear train, such as, for example, a planetary gear train 482. The planetary gear train 482 may step up the angular speed to an output shaft 484 that, in turn, drives a flywheel 486. Because the flywheel, when spinning, has angular inertia, the illustrated embodiment may also provide a foot pedal that resists deceleration of its angular rotation.

Referring to FIGS. 24A and 24B, another example flywheel-based feedback device is shown. In the depicted embodiment, the pedal 136 may turn a flywheel via a cable 502 and a cable 504. The cables 502, 504 may attach at respective heel and toe ends of pedal 136. The cables 502, 504 may be redirected around free spinning pulleys 506, 508, respectively, and wrap around pulley flywheel 510, which has a vertically oriented axis 511 that is perpendicular to the pedal's pivot axis. Free spinning pulleys 506, 508 may rotate about a horizontal axis. Free spinning pulleys 506, 508 may be attached to the support plate 138 and angled in an orientation so that the cables are directed to tangents of the flywheel 510. In this way, the cables 502, 504 are directed toward proper engagement with flywheel 510. The cables 502, 504 attach to the flywheel at attachment points 512, 514, respectively. As a user presses down on the heel end of the pedal, cable 504 pulls the flywheel in a first direction, and the flywheel spools up cable 502 thereby providing a resistance force. Similarly, as the user presses down on the toe end of the pedal, cable 502 pulls the flywheel in a second direction, and the flywheel spools up cable 504 thereby providing a resistance force.

Referring to FIG. 25, yet another example flywheel-based feedback device is provided. The flywheel 520 may pivot about an axis 522 that is parallel to the pivot axis of pedal 136. A cable 524 may be wrapped around the flywheel 520. As the pedal 136 is pivoted, the cable 524 may pull the flywheel via friction between the cable and the flywheel, thereby providing a resistance force.

In some embodiments, the cables 502, 504, 524 may drive pulleys that are rotationally fixed, via a shared shaft, to their respective flywheels. Said driven pulleys may have smaller diameters than their respective flywheels so that smaller movements of the cables' respective ends cause respectively larger angular movement of the flywheels. The mass and dimensions of the flywheels 486, 510, and 520 may be selected to provide a predetermined amount of inertia.

FIG. 26 illustrates another example feedback device system that uses a damper (such as described with respect to FIG. 6), but instead of the damper interacting via gears, the damper 710 interacts with a belt 766. Notably, the stationary damper 710 includes teeth receiving notches 712 that are designed to receive corresponding teeth 767 in the belt 766. Thus, as the foot pedal 736 tilts, the belt 766 causes the damper 710 to rotate to thereby provide the desired resistance force. Notably, other connection methods between the belt and damper are contemplated (e.g., the teeth could be on the damper and the notches or holes on the belt, there could be a single connection point, etc.)

In some embodiments, such as some of the above described embodiments, the feedback device includes a motor, brake, or other feature that can prevent further tilting (change in angular position) of the foot pedal. In such embodiments, the feedback device may be configured to prevent angular movement of the foot pedal, such as when it is determined that the corresponding rotation of the direction of the trolling motor shaft has ceased (or can't go any further—such as due to mud, rocks, stalling, etc.).

Similarly, in some embodiments, the feedback device may operate independently of the user providing input to the foot pedal and may drive the angular position of the foot pedal to stay in sync with the direction of trolling motor shaft. As an example, the trolling motor shaft may be changing direction autonomously, such as during performance of a virtual anchoring feature. In response, and without the user providing input, the feedback device may cause the foot pedal to change its angular position to match how the trolling motor shaft is turning. This provides a visual clue to the user that the direction of the trolling motor shaft is changing.

Example Foot Pedal Switches

As detailed herein, some embodiments of the present invention provide a foot pedal assembly configured for remotely controlling a trolling motor assembly. In some embodiments, one or more switches may be attached to the foot pedal adjacent to the pedal's upper (e.g., an engagement) surface and that pivot with the pedal so that they stay in the same position with respect to the pivoting pedal's upper surface. Accordingly, this configuration makes it easier to access the buttons regardless of the pedal's orientation. Notably, in comparison, in pedal designs in which buttons are attached to the fixed support plate in the front, when the pedal is pivoted so that the heel edge is proximate the support plate, the buttons are difficult to press, and when the pedal is pivoted so that the toe edge is proximate the support plate, the buttons are subject to accidental activation.

Referring to FIGS. 3-4, in some embodiments, one or more buttons 600 may be disposed on the foot pedal 136. The buttons may be disposed adjacent an engagement surface on the pedal's upper surface so that they are outside of a user's footprint when the user rests a foot on the pedal, yet sufficiently proximate the footprint so that the buttons are accessible via a user pivoting his or her foot about the toe and pressing with the heel. That is, the foot pedal may define an engagement surface that is sized to receive a user's foot (e.g., shoe sole). The buttons 600 may be disposed adjacent the engagement surface so that the user may place a foot on the pedal without actuating the buttons 600. In some embodiments, the buttons 600 may be disposed proximate a front edge of the foot pedal such that a user may utilize their toes to activate the buttons. In some embodiments, the foot pedal may have two buttons on each side, one in front of the other in the pedal's longitudinal dimension. That is, the pedal may include two front buttons 600A and two rear buttons 600B, such as shown in FIG. 3.

In some embodiments, the buttons may be actuatable by a downward force that is less than the force required to pivot the pedal. For example, in some embodiments, the force required to actuate each of the buttons times the buttons' respective distance from the pedal's pivotal axis may be less than the torque required to overcome the static friction that holds the pedal in place.

In some embodiments, the buttons may be pivotably attached to the pedal so that they attach at a proximal end 602 and deflect downward when pressed. In this way, the buttons may be difficult to press when pressed near their proximal side, thereby preventing accidental actuation. Moreover, the buttons may have raised portions 606 near or at their respective distal ends 604. In this way, a user pressing down across a button's entire surface with a flat foot or shoe sole engages the raised portions 606, thereby directing the user's downward force to the distal end and maximizing the torque about the button's pivotal axis and minimizing the force required to actuate the button. Accordingly, it may be difficult to actuate the buttons from a position close to the engagement surface yet easy to press the buttons at a position further from the engagement surface, thereby minimizing accidental actuation while maximizing ease of intentional actuation.

The raised portions 606 may extend parallel to the main length dimension of the pedal's upper surface. The raised portions of the distal ends may, for example, be protrusions that extend along the distal edges 604. The rear buttons may have second raised portions 608 that extend further than the front buttons' raised portions 606. In this way, the user may be able to more easily actuate the rear buttons without accidentally actuating the respective front button on the same side.

In some embodiments, the buttons 600 may activate various operations of the trolling motor assembly (or other systems). For example, the buttons 600 may activate certain navigation operations. When pressed, the buttons may actuate switches that communicate with the controller 179 via processor 180 (shown in FIG. 7). One button 600 may, for example, cause the trolling motor to maintain a heading. Another button 600 may be a "virtual anchor," that causes the trolling motor to maintain the boat at a specific location (e.g., by maintaining GPS coordinates). Yet another button 600 may cause the boat to head to a waypoint. Accordingly, said buttons 600 may actuate the processor 116 to actuate autopilot navigation assembly 126. Other buttons 600 may be programmable. For example, a user may determine the desired operation that corresponds to the specific button. In this regard, a user interface may enable configuration by the user—enabling user specific button configurations.

Referring again to FIGS. 3-4, example embodiments of foot pedal assemblies in accordance with the present invention may include a depressable momentary button 142 that may be positioned on either the left or the right side of the housing of the foot pedal assembly 130. Depending on the desired configuration, the momentary button 142 may control whether power is supplied to the propulsion motor and/or the corresponding speed of the propulsion motor. As shown, the button 142 is positioned on the left side of the foot pedal assembly 130.

As previously noted, in some embodiments, a pressure sensor (switch) for controlling operation/rate of direction change of the propeller 112 via the propulsion motor 111 may be operated by a user via the depressable momentary button 142. In some embodiments, as a user depresses the button 142 onto the corresponding pressure sensor, a pressure, or force, may be applied to the pressure sensor and the sensor measures the amount of pressure. As the amount of pressure on the button 142 is increased, the amount of pressure measured by the pressure sensor also increases. In some embodiments, rate of turn of the direction of the trolling motor shaft may be a function of the magnitude of the force measured by the pressure sensor. In this regard, as the amount of force exerted on the pressure sensor by the button 142 increases, the rate of turn of the direction of the trolling motor shaft may also increase, for example, proportionally based on a linear or exponential function. Further information regarding operation concerning an example pressure sensor and momentary switch can be found in U.S. application Ser. No. 15/835,752, entitled "Foot Pedal for a Trolling Motor Assembly", which is assigned to the Assignee of the present invention and incorporated by reference herein in its entirety.

As shown, in some embodiments, the variable speed feature of the trolling motor assembly 100, may be controlled by the speed wheel 197. For example, the speed wheel 197 may be used to select a scale number between "0" and "10," thereby limiting the top end speed of the trolling motor assembly 100 that is achievable via depressing the button 142. For example, where a trolling motor assembly 100 has a maximum speed of 10 mph when the speed wheel 197 is set on scale number "10," the maximum speed achievable by the trolling motor assembly 100 will only be 5 mph when the speed wheel 197 is set on scale number "5." Note, the use of a scale from "0 to 10" is only selected for the sake of example, other scales may be used to represent the range of speeds selectable by the user. As well, in alternate embodiments a linear-type input device, such as a slide, may be utilized rather than the rotary-type speed wheel to input speed control commands.

As well, in some example embodiments, the speed wheel 197 may be used to select a range of speeds within which the trolling motor assembly operates. For example, in addition to, or in place of, the previously discussed scale of "0" to "10," the speed wheel 197 may include ranges of speeds such as, but not limited to, "0-3," "3-6" and "6-10." As such, if a user select the range of "3-6," the trolling motor assembly will operate within that range when activated. Note, the noted ranges do not necessarily reflect actual speeds unless the top speed achievable by the trolling motor assembly 100 happens to be 10 mph.

Example System Architecture

FIG. 7 shows a block diagram of a trolling motor assembly 100 in communication with a navigation control device 131. As described herein, it is contemplated that while certain components and functionalities of components may be shown and described as being part of the trolling motor assembly 100 or the navigation control device 131, according to some example embodiments, some components (e.g., the autopilot navigation assembly 126, portions of the sonar assembly 118, functionalities of the processors 124 and 180, or the like) may be included in the other of the trolling motor assembly 100 or the navigation control device 131 (or in other systems/assemblies altogether).

As depicted in FIG. 7, the trolling motor assembly 100 may include a processor 116, a memory 120, a speed actuator 128, a steering actuator 129, a propulsion motor 111, and a communication interface 124. According to some example embodiments, the trolling motor assembly 100 may also include an autopilot navigation assembly 126 and a sonar assembly 118.

The processor 116 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 116 as described herein. In this regard, the processor 116 may be configured to analyze electrical signals communicated thereto, for example in the form of a speed input signal received via the communication interface 124, and instruct the speed actuator to rotate the propulsion motor 111 (FIG. 2) and, therefore, propeller 112 (FIG. 2) in accordance with a received desired speed.

The memory 120 may be configured to store instructions, computer program code, trolling motor steering codes and instructions, marine data (such as sonar data, chart data, location/position data), and other data in a non-transitory computer readable medium for use, such as by the processor 116.

The communication interface 124 may be configured to enable connection to external systems (e.g., trolling motor assembly 100, a remote marine electronic device, etc.). In this manner, the processor 116 may retrieve stored data from remote, external servers via the communication interface 124 in addition to or as an alternative to the memory 120.

The processor 116 may be in communication with and control the speed actuator 128. Speed actuator 128 may be electronically controlled to cause the propulsion motor 111 to rotate the propeller at various rates (or speeds) in response to respective signals or instructions. As described above with respect to speed actuator 128, speed actuator 128 may be disposed in either the main housing 110 or the trolling motor housing 108, and is configured to cause rotation of the propeller in response to electrical signals. To do so, speed actuator 128 may employ a solenoid configured to convert an electrical signal into a mechanical movement.

The propulsion motor 111 may be any type of propulsion device configured to urge a watercraft through the water. As noted, the propulsion motor 111 is preferably variable speed to enable the propulsion motor 111 to move the watercraft at different speeds or with different power or thrust.

According to some example embodiments, the autopilot navigation assembly 126 may be configured to determine a destination (e.g., via input by a user) and route for a watercraft and control the steering actuator 129, via the processor 116, to steer the propulsion motor 111 in accordance with the route and destination. In this regard, the processor 116 and memory 120 may be considered components of the autopilot navigation assembly 126 to perform its functionality, but the autopilot navigation assembly 126 may also include position sensors. The memory 120 may store digitized charts and maps to assist with autopilot navigation. To determine a destination and route for a watercraft, the autopilot navigation assembly 126 may employ a position sensor, such as, for example, a global positioning system (GPS) sensor (e.g., a positioning sensor). Based on the route, the autopilot navigation assembly 126 may determine that different rates of turn for propulsion may be needed to efficiently move along the route to the destination. As such, the autopilot navigation assembly 126 may instruct the steering actuator 128, via the processor 116, to turn.

The sonar assembly 118 may also be in communication with the processor 116, and the processor 116 may be considered a component of the sonar assembly 118. The sonar assembly 118 may include a sonar transducer that may be affixed to a component of the trolling motor assembly 100 (e.g., on the outside or inside of the main housing) that is disposed underwater when the trolling motor assembly 100 is operating. In this regard, the sonar transducer may be in a housing and configured to gather sonar data from the underwater environment surrounding the watercraft. Accordingly, the processor 116 (such as through execution of computer program code) may be configured to receive sonar data from the sonar transducer, and process the sonar data to generate an image based on the gathered sonar data. In some example embodiments, the sonar assembly 118 may be used to determine depth and bottom topography, detect fish, locate wreckage, etc. Sonar beams, from the sonar transducer, can be transmitted into the underwater environment and echoes can be detected to obtain information about the environment. In this regard, the sonar signals can reflect off objects in the underwater environment (e.g., fish, structure, sea floor bottom, etc.) and return to the transducer, which converts the sonar returns into sonar data that can be used to produce an image of the underwater environment.

As mentioned above, the trolling motor assembly 100 may be in communication with a navigation control device 131 that is configured to control the operation of the trolling motor assembly 100. In this regard, the navigation control device 131 may include a processor 180, a memory 184, a communication interface 186, and a user input assembly 130.

The processor 180 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 180 as described herein. In this regard, the processor 180 may be configured to analyze signals from the user input assembly 130 and convey the signals or variants of the signals, via the communication interface 186 to the trolling motor assembly 100 to cause the trolling motor assembly 100 to operate accordingly.

The memory 184 may be configured to store instructions, computer program code, trolling motor steering codes and instructions, marine data (such as sonar data, chart data, location/position data), and other data in a non-transitory computer readable medium for use, such as by the processor 180.

The communication interface 186 may be configured to enable connection to external systems (e.g., communication interface 124, a remote marine electronics device, etc.). In this manner, the processor 180 may retrieve stored data from a remote, external server via the communication interface 186 in addition to or as an alternative to the memory 184.

Communication interfaces 124 and 180 may be configured to communicate via a number of different communication protocols and layers. For example, the link between the communication interface 124 and communication interface 186 any type of wired or wireless communication link. For example, communications between the interfaces may be conducted via Bluetooth, Ethernet, the NMEA 2000 framework, cellular, WiFi, or other suitable networks.

According to various example embodiments, the processor 180 may operate on behalf of both the trolling motor assembly 100 and the navigation control device 131. In this regard, processor 180 may be configured to perform some or all of the functions described with respect to processor 116 and may communicate directly to the autopilot navigation assembly 126, the sonar assembly 118, the steering actuator 129, and the speed actuator 128 directly via a wired or wireless communication.

The processor 180 may also interface with the user input assembly 130 to obtain information including a desired speed of the propulsion motor based on user activity. In this regard, the processor 180 may be configured to determine a desired speed of operation based on user activity detected by the user input assembly 130, and generate a speed input signal. The speed input signal may be an electrical signal indicating the desired speed. Further, the processor 180 may be configured to direct the speed actuator 128, directly or indirectly, to rotate the shaft of the propulsion motor 111 at a desired speed based on the speed indicated in the steering input signal. According to some example embodiments, the processor 180 may be further configured to modify the rate of rotation indicated in the speed input signal to different values based on variations in the user activity detected by the user input assembly 130.

Various example embodiments of a user input assembly 130 may be utilized to detect the user activity and facilitate generation of a steering input signal indicating a desired speed of propulsion motor. To do so, various sensors including feedback sensors, and mechanical devices that interface with the sensors, may be utilized. For example, a deflection sensor 182 and a pressure sensor 143 may be utilized as sensors to detect user activity. Further, the foot pedal 136 and depressable momentary button 142 may be mechanical devices that are operably coupled to the sensors and may interface directly with a user to facilitate various operations via the user input assembly 130 (i.e. foot pedal assembly).

According to some example embodiments, the buttons 600 may activate various operations of the trolling motor assembly or other systems. As noted herein, in some embodiments, the buttons 600 may be user configurable.

In some embodiments, one or more of the functions described herein may be embodied by computer program instructions of a computer program product. In this regard, the computer program product(s) which embody the procedures described herein may be stored by, for example, the memory 120 or 184 and executed by, for example, the processor 116 or 180. As will be appreciated, any such computer program product may be loaded onto a computer or other programmable apparatus to produce a machine, such that the computer program product including the instructions which execute on the computer or other programmable apparatus creates means for implementing the functions described herein. Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

Example System for Providing Feedback Related to Stalled Motor Rotation

As described herein, trolling motors, when in use, can be susceptible to damage when they are further rotated when the submerged trolling motor housing is stuck or when rotation is blocked. Such a situation may occur, particularly when operating in shallow water, due to various hazards, such as bumping into rocks, getting tangled in seaweed, stuck in mud, among other things. As a result, attempts to further turn the trolling motor housing (e.g., the direction the trolling motor housing faces) may not work and/or could result in damage to the trolling motor housing and/or the steering assembly that is attempting to rotate the direction of the trolling motor housing. In some cases, such a situation results in stalling of the steering assembly (e.g., stalling of the rotation of the direction of the trolling motor housing).

Some embodiments of the present invention provide systems that are designed to sense occurrence of a stall in the steering assembly of the trolling motor and, in response, provide feedback to the user attempting to cause the rotation. Based on the feedback, the user can stop further attempted turning of the trolling motor housing to prevent damage from occurring. Depending on the configuration, such feedback could be in any form, such as haptic, audible, and/or visual feedback. Further, depending on the design of the trolling motor system, the feedback could be provided through the user input assembly (e.g., foot pedal) and/or through a remote control device.

FIG. 27 illustrates an example trolling motor system 800 including a trolling motor assembly 803 that is electric and may be controlled with a foot pedal assembly 830 (although trolling motor assemblies that are manual (e.g., hand controlled) or hybrid (electrical and manual) are also contemplated). The trolling motor assembly 803 includes a shaft 802 defining a first end 804 and a second end 806, a trolling motor housing 808, and a main housing 810. The trolling motor housing 808 is attached to the second end 806 of the shaft 802 and at least partially contains a propulsion motor 811, or trolling motor, that connects to a propeller 812. As shown in FIG. 1, in some embodiments, when the trolling motor assembly is attached to the watercraft 10 and the propulsion motor (or trolling motor housing) is submerged in the water, the propulsion motor is configured to propel the watercraft to travel along the body of water. In addition to containing the propulsion motor 811, the trolling motor housing 808 may include other components such as, for example, a sonar transducer assembly and/or other sensors or features (e.g., lights, temperature sensors, etc.).

The main housing 810 is connected to the shaft 802 proximate the first end 804 of the shaft 802. The shaft 802 is rotatable to control the direction the trolling motor housing 808 faces (e.g., through angular rotation about axis A1). The depicted example includes a user input assembly (e.g., a foot pedal) 830 that is enabled to control operation of the trolling motor assembly 803 for some embodiments described herein. As shown in FIG. 1, in some embodiments, when the trolling motor assembly is attached to the watercraft and the propulsion motor is submerged in the water, the main housing is positioned out of the body of water and visible/accessible by a user. The main housing 810 may be configured to house components of the trolling motor assembly, such as may be used for processing marine data and/or controlling operation of the trolling motor, among other things. For example, depending on the configuration and features of the trolling motor assembly, the trolling motor assembly 803 may contain, for example, one or more of a processor, a sonar assembly, memory, a communication interface, an autopilot navigation assembly, a speed actuator, and a steering assembly 831 for the propulsion motor 811/trolling motor housing 808.

Referring to FIG. 27, as noted, in some embodiments, the trolling motor assembly 803 includes a foot pedal assembly 830 that is electrically connected to the propulsion motor 811 (such as through the main housing 810) using a cable 132 (although it could be connected wirelessly). The foot pedal assembly 830 may enable a user to steer and/or otherwise operate the trolling motor assembly 803 to control the direction and speed of travel of the watercraft. In an example embodiment, the foot pedal assembly 830 may provide steering commands, which in turn are used to cause a steering assembly 831 to steer the trolling motor housing 808 about axis A1 to a desired direction. In some embodiments, though not shown, the foot pedal assembly 830 may be connected to the shaft 802 and utilize direct mechanical steering (such as through ropes/wires) to cause steering of the trolling motor housing 808. Further, depending on the configuration of the foot pedal assembly, the foot pedal assembly 830 may include an electrical plug 834 that can be connected to an external power source.

Additionally or alternatively, the trolling motor assembly 803 may include a remote control device 840 (e.g., a handheld remote control). The remote control 840 may be wired or wirelessly connected to the main housing and provide commands/instructions (e.g., steering commands to the trolling motor assembly 803). In this regard, one or more buttons, touchscreen options, or other input options may be present on the remote control device and enable a user to provide such commands to the trolling motor assembly. The remote control 840 may be a dedicated control or may be a control interface executed on a user device, such as a tablet computer, smart phone, marine electronics device (such as mounted to the watercraft), or the like.

The trolling motor assembly 803 may also include an attachment device 827 (e.g., a clamp, a mount, or a plurality of fasteners) to enable connection or attachment of the trolling motor assembly 803 to the watercraft. Depending on the attachment device used, the trolling motor assembly 803 may be configured for rotational movement relative to the watercraft about the shaft's axis A1, including, for example, 360 degree rotational movement.

Turning to operation of the trolling motor assembly 803, in electrical mode, the processor may receive one or more steering commands from the wired or wireless controller, e.g. user input assembly 830 or remote control device 840. The processor may, in turn, cause the steering assembly 831 to steer the trolling motor housing 808 based on the one or more steering commands. For example, the processor may cause a steering motor of the steering assembly 831 to energize and cause rotation of the shaft 802 in a first direction. The steering motor may, for example, cause a drive belt, drive gears, or the like to rotate the shaft 802 about axis A1 to a desired direction. Similarly, the steering motor may be energized and rotate in a second direction opposite the first direction, thus causing the trolling motor housing 808 to rotate about axis A1 in the opposite direction.

In some embodiments, the trolling motor system may include a user input assembly, such as may be in the form of a foot pedal assembly 830. As described herein, the foot pedal assembly 830 may include a support plate 838 that may be attached (removably or otherwise) to the watercraft or other surface. A foot pedal portion 836 may be rotatably attached to the support plate 838 and configured to rotate about an axis 890. The foot pedal defines a top surface that is configured to receive a user's foot thereon (see e.g., FIG. 4). Deflection of the foot pedal about the axis 890 may cause a corresponding rotation in a direction that the trolling motor housing 808 is oriented about its shaft 802. Depending on the configuration of the trolling motor system and the foot pedal, the foot pedal assembly may be configured to control such rotation manually (e.g., through steering cables), electrically (e.g., by sensing rotational position of the foot pedal relative to the support plate and providing steering commands to the trolling motor for utilizing the steering assembly 831), or both. In some embodiments, the steering commands may be issued automatically, such as in response to a navigation program, such as to enable automatic travel along a route.

In some embodiments, the trolling motor system may include a remote control device 840 (and/or a remote computing device). The remote control device 840 may include a user interface configured to receive user input from a user. In this regard, a user may provide user input that can ultimately cause corresponding rotation in a direction that the trolling motor housing is oriented about its shaft. To explain, a user may provide user input indicating a desire to change the direction of the trolling motor housing. In response, a control signal (e.g., steering command(s)) may be sent (wired or wirelessly) to the trolling motor for utilizing the steering assembly 831 to cause the direction of the trolling motor housing to change. As noted herein, in some embodiments, a remote computing device, such as a user's mobile device, a marine electronics device, remote server, etc., may be utilized enable a user to provide user input indicating a desire to change the direction of the trolling motor housing. In response, a corresponding control signal may be sent from the remote computing device. In some embodiments, the steering commands may be issued automatically, such as in response to a navigation program, such as to enable automatic travel along a route.

In some embodiments, one or more processors of the trolling motor system may be configured to determine that rotation of the trolling motor housing about its shaft has stalled or is about to stall. As described herein, the trolling motor housing may be susceptible to damage when it is further rotated when it is stuck or blocked, such as due to various hazards (e.g., bumping into rocks, getting tangled in seaweed, stuck in mud, among other things). In this regard, attempts to further turn the trolling motor housing may not work and/or could result in damage to the trolling motor housing and/or the steering assembly that is attempting to rotate the trolling motor housing. Generally, however, such situations result in stalling of the motor of the steering assembly. Thus, some embodiments of the present invention seek to determine when the steering assembly stalls or is about to stall in order to help prevent any damage from occurring.

Depending on the configuration of the system, the processor performing the determination may be positioned in the user input assembly, in the trolling motor assembly, and/or in the remote control device/remote computing device. In some embodiments, the processing may occur across multiple processors that may be located in discrete locations/systems.

In some embodiments, the one or more processors of the trolling motor systems may be configured to determine when the current rotational direction of the trolling motor housing is out of sync with the expected rotational direction. In some embodiments, the trolling motor system may include one or more sensors configured to detect the current rotational direction of the trolling motor housing and compare it to the expected rotational direction of the trolling motor housing to determine if the two rotational directions do not match.

For example, the trolling motor housing or shaft may include an orientation sensor configured to determine the orientation of the direction of the trolling motor housing. The trolling motor system may utilize data from the orientation sensor to determine the current rotational direction of the trolling motor housing. In some embodiments, other sensors may be utilized to determine the current rotational direction of the trolling motor housing.

Additionally, the trolling motor system may be configured, such as via one or more processors, to determine an expected rotational direction of the trolling motor housing. For example, the trolling motor system may determine the current user input being provided or the current instructions being provided to the trolling motor for controlling the rotational direction of the trolling motor housing. Based on that information, the expected rotational direction of the trolling motor housing may be determined. For example, a position sensor on the foot pedal assembly may be configured to determine a deflected position of the foot pedal, which could then be used to determine the expected rotational direction of the trolling motor housing. In some embodiments, other sensors may be utilized to determine the expected rotational direction of the trolling motor housing.

In some embodiments, once determined, the current rotational direction and the expected rotational direction of the trolling motor housing can be compared. If the two are out of sync, the trolling motor system may determine that the rotation of the trolling motor housing has stalled or is about to stall.

In some embodiments, the one or more processors of the trolling motor systems may be configured to determine that the rotation of the trolling motor housing has stalled or is about to stall when current draw on the motor of the steering assembly is above a threshold level—indicating that the motor is drawing too much current. In such example embodiments, the trolling motor system may include a motor current sensor that is configured to sense current draw utilized by a motor of the steering assembly during operation of the steering assembly to rotate the direction of the trolling motor housing. In this regard, when stalling or about to stall, the motor may be drawing an unordinary amount of current in an effort to further rotate the trolling motor housing. The trolling motor system may sense this and use it to determine that a stall is occurring or about to occur, such as by comparing the current draw of the motor during operation to a predetermined current draw threshold.

Though the above examples focus on determining either (i) when the current rotational direction of the trolling motor housing is out of sync with the expected rotational direction of the trolling motor housing; or (ii) when too much current is being drawn by the motor of the steering assembly, other example methods of determining occurrence of a stall are contemplated.

In some embodiments, the trolling motor system may be configured to cause, in response to determining that rotation of the trolling motor housing about the shaft axis has stalled or is about to stall, a feedback device to provide at least one of haptic, audible, or visual feedback. In this regard, a feedback device may be positioned within/on at least one of the user input assembly (e.g., the foot pedal assembly) or the remote control device (or a remote computing device). The feedback device may provide the haptic, audible, and/or visual feedback in response to determining that the rotation of the direction of the trolling motor is stalling or about to stall in order to alert the user so that they can stop the rotation and prevent damage from occurring. Various types of feedback devices are contemplated, such as one or more of a speaker, a screen, an indicator (such as one or more light emitting diodes), an eccentric rotating mass (ERM), a linear resonant actuator (LRA), a piezoelectric actuator, a forced impact (e.g., accelerated ram) actuator, or other feedback systems. In this regard, depending on the desired configuration, haptic (e.g., vibrational) feedback may be provided to a user, which can mimic the feel of resistance to rotation of the trolling motor housing—thereby forming an intuitive alert.

In some embodiments, the trolling motor system, such as via one or more processors, may be configured to determine where the steering commands are being provided from. For example, the trolling motor system may determine that the steering commands are coming from a user input assembly, such as a foot pedal assembly. Alternatively, the trolling motor system may determine that the steering commands are coming from a remote control device or a remote computing device. In response, the trolling motor system may cause the feedback device associated with that input system (e.g., the user input assembly or remote control/computing device) to provide the haptic, visual, and/or audible feedback. In some such example embodiments, only the relevant feedback device may operate—thereby removing unnecessary warnings/alerts.

FIG. 28 shows a block diagram of an example trolling motor system 900 capable for use with several embodiments of the present invention. As shown, the trolling motor system 900 may include a number of different modules or components, each of which may comprise any device or means embodied in either hardware, software, or a combination of hardware and software configured to perform one or more corresponding functions. For example, the trolling motor system 900 may include a trolling motor assembly 903 (that includes, for example, a main housing 905 and a trolling motor housing 950), a user input assembly 930 (e.g., a foot pedal assembly), and a remote control device 970. While the user input assembly 930 and the remote control device 970 are shown as being outside the trolling motor assembly 903, in some embodiments, one or more of them may be included within the trolling motor assembly 903. Similarly, though the remote control device 970 is labeled as a remote control, in some embodiments, the remote control device may be embodied as a remote computing device, such as a marine electronics device.

The trolling motor system 900 may also include one or more communications modules configured to communicate with one another in any of a number of different manners including, for example, via a network. In this regard, the communication interface (e.g., 924, 924', 924") may include any of a number of different communication backbones or frameworks including, for example, Ethernet, the NMEA 2000 framework, GPS, cellular, WiFi, or other suitable networks. The network may also support other data sources, including GPS, autopilot, engine data, compass, radar, etc. Numerous other peripheral, remote devices such as one or more wired or wireless multi-function displays may be connected to the trolling motor system 900.

The trolling motor assembly 903 may include a main housing 905 and a trolling motor housing 950 (and, in some embodiments, a shaft therebetween). Though various modules/systems are shown within one or more of the main housing 905 and/or the trolling motor housing 950, various modules/systems may be present outside of a main housing or trolling motor housing, but still a part of the trolling motor assembly 903.

The main housing 905 may include a processor 910, a sonar signal processor 915, a memory 920, a communication interface 924, display 940, a user interface 935, a steering assembly 990, and one or more sensors (e.g., location sensor 946, a position sensor 980, a motor current sensor 981, etc.).

The processor 910 and/or a sonar signal processor 915 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 910 as described herein.

In this regard, the processor 910 may be configured to analyze electrical signals communicated thereto to provide display data to the display 940 (or other remote display). In some example embodiments, the processor 910 or sonar signal processor 915 may be configured to receive sonar data indicative of the size, location, shape, etc. of objects detected by the system 900 (such as from sonar transducer assembly 960). For example, the processor 910 may be configured to receive sonar return data and process the sonar return data to generate sonar image data for display to a user. In some embodiments, the processor 910 may be further configured to implement signal processing or enhancement features to improve the display characteristics or data or images, collect or process additional data, such as time, temperature, GPS information, waypoint designations, or others, or may filter extraneous data to better analyze the collected data. It may further implement notices and alarms, such as those determined or adjusted by a user, to reflect depth, presence of fish, proximity of other watercraft, etc. In some embodiments, such as described in various embodiments herein, the processor 910 (and/or other processors 910', 910" working separately or sharing functionality) may be configured to determine when the rotation of the direction of the trolling motor is stalling or about to stall and, in response, cause a feedback device to provide feedback to a user to indicate such an occurrence.

The memory 920 may be configured to store instructions, computer program code, marine data, such as sonar data, chart data, location data, motor current sensor data, position/orientation sensor data, and other data associated with the trolling motor system in a non-transitory computer readable medium for use, such as by the processor.

The communication interface 924 may be configured to enable connection to external systems (e.g., an external network 902) and/or other systems, such as the user input assembly 930 and remote control device 970. In this manner, the processor 910 may retrieve stored data from a remote, external server via the external network 902 in addition to or as an alternative to the onboard memory 920.

The position/orientation sensor 980 may be found in one or more of the main housing 905, the trolling motor housing 950 (see position/orientation sensor 992), steering assembly 990, or remotely. In some embodiments, the position/orientation sensor 980 may be configured to determine a direction of which the trolling motor housing is facing. In some embodiments, the position/orientation sensor 980 may be operably coupled to either the shaft or steering assembly 990, such that the position/orientation sensor 980 measures the rotational change in position of the trolling motor housing 950 as the trolling motor is turned. The position/orientation sensor 980 may be a magnetic sensor, a light sensor, mechanical sensor, or the like.

The location sensor 946 may be configured to determine the current position and/or location of the main housing 905. For example, the location sensor 946 may comprise a GPS, bottom contour, inertial navigation system, such as micro electro-mechanical sensor (MEMS), a ring laser gyroscope, or the like, or other location detection system.

The steering assembly 990 may include a motor (or other mechanism) configured to engage and rotate the shaft of the trolling motor assembly. For example, the motor may rotate to move a belt drive, gear drive, or the like. The drive belt may rotate the shaft to cause the trolling motor housing 950 to be positioned to a desired direction of a plurality of directions.

The motor current sensor 981 may be any type of sensor (or sensors) configured to determine the amount of current the motor of the steering assembly 990 is drawing during operation thereof.

The display 940 may be configured to display images and may include or otherwise be in communication with a user interface 935 configured to receive input from a user. The display 940 may be, for example, a conventional LCD (liquid crystal display), an LED display, or the like. In some example embodiments, additional displays may also be included, such as a touch screen display, mobile device, or any other suitable display known in the art upon which images may be displayed. In any of the embodiments, the display 940 may be configured to display relevant trolling motor information including, but not limited to, speed data, motor data battery data, current operating mode, auto pilot, operation mode, or the like.

The user interface 935 may include, for example, a keyboard, keypad, function keys, mouse, scrolling device, input/output ports, touch screen, or any other mechanism by which a user may interface with the system.

The trolling motor housing 950 may include a trolling motor 955, a sonar transducer assembly 960, and one or more other sensors (e.g., a position/orientation sensor 992, water temperature sensor, water current sensor, etc.), which may each be controlled through the processor 910 (such as detailed herein).

The user input assembly 930 may be any device capable of receiving user input and controlling, at least, some operations of the trolling motor system. For example, the user input assembly 930 may be a foot pedal, such as in various embodiments described herein. Depending on the configuration of the trolling motor system, the user input assembly 930 may include a processor 910', memory 920', communication interface 924', a deflection sensor 993', and a feedback device 995'. In some embodiments, the user input assembly 930 may include a display, such as part of the user interface.

The processor 910', memory 920', and communication interface 924' may include features and functions such as described herein with respect to the corresponding module/system in the trolling motor assembly 903 (e.g., the processor 910, the memory 920, and communication interface 924).

The deflection sensor 993' may be any device capable of sensing the position/deflection of a portion of the user input assembly, such as the foot pedal of the user input assembly 930 (e.g., as described in various embodiments herein).

The feedback device 995' may be any device capable of providing haptic, audible, and/or visual feedback. In some embodiments, the feedback device may provide the feedback in response to determining that the rotation of the direction of the trolling motor housing is stalling or about to stall in order to alert the user so that they can stop the rotation and prevent damage from occurring. Various types of feedback devices are contemplated, such as one or more of a speaker, a screen, an indicator (such as one or more light emitting diodes), an eccentric rotating mass (ERM), a linear resonant actuator (LRA), a piezoelectric actuator, a forced impact (e.g., accelerated ram) actuator, or other feedback systems.

The remote control device 970 may be any device capable of receiving user input and controlling, at least, some operations of the trolling motor system remotely. For example, the remote control device 970 may be a wired or wireless remote control, such as in various embodiments described herein, or a remote computing device, such as a marine electronics device of a watercraft. Depending on the configuration of the trolling motor system, the remote control device 970 may include a processor 910", memory 920", communication interface 924", display 940", and a feedback device 995".

The processor 910", memory 920", communication interface 924", display 940", and feedback device 995" may include features and functions such as described herein with respect to the corresponding module/system in the trolling motor assembly 903 (e.g., the processor 910, the memory 920, display 940, and communication interface 924) or the user input assembly 930 (e.g., the processor 910', the memory 920', communication interface 924', and the feedback device 995').

Embodiments of the present invention provide various methods for controlling operation of the trolling motor system. Various examples of the operations performed in accordance with embodiments of the present invention will now be provided with reference to FIG. 29.

FIG. 29 illustrates a flowchart according to an example method for operating a trolling motor system according to some example embodiments. The operations illustrated in and described with respect to FIG. 29 may, for example, be performed by, with the assistance of, and/or under the control of one or more of the processor 910, 910', 910", sonar signal processor 915, memory 920, 920', 920", communication interface 924, 924', 924", user interfaces 935, 935', 935", location sensor 946, position/orientation sensor 980, 992, motor current sensor 981, display 940, 940", deflection sensor 993', feedback device 995', 995", user input assembly 930, remote control device 970, and/or steering assembly 990.

The method for operating the trolling motor system depicted in FIG. 29 may include determining that rotation of the trolling motor housing has stalled or is about to stall at operation 1002 and causing an audible, haptic, and/or visual feedback using a feedback device, such as at a user input assembly or a remote control device, at operation 1004.

In some embodiments, the method for operating the trolling motor system may include additional, optional operations, and/or the operations described above may be modified or augmented. Some examples of modifications, optional operations, and augmentations are described below, as indicated by dashed lines, such as receiving trolling motor housing orientation data at operation 1012, determining an expected orientation of the trolling motor housing at operation 1014, and comparing the expected trolling motor housing orientation with the actual trolling motor housing orientation at operation 1016, such as to determine that the rotation of the trolling motor housing has stalled or is about to stall (e.g., at operation 1002).

In some embodiments, the method may include monitoring motor current draw at operation 1022 and determining if the motor current draw exceeds a threshold motor current draw at operation 1024, such as to determine that the rotation of the trolling motor housing has stalled or is about to stall (e.g., at operation 1002).

FIG. 29 illustrates a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 920, 920', 920" and executed by, for example, the processor 910, 910', 910". As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A trolling motor system comprising:

a trolling motor assembly configured for attachment to a watercraft, wherein the trolling motor assembly comprises:

a shaft defining a first axis, wherein the shaft defines a first end and a second end;

a trolling motor at least partially contained within a trolling motor housing, wherein the trolling motor housing is attached to the second end of the shaft, wherein, when the trolling motor assembly is attached to the watercraft and the trolling motor housing is submerged in a body of water, the trolling motor, when operating, is configured to propel the watercraft to travel along the body of water;

a user input assembly comprising:

a support plate;

a foot pedal pivotably mounted to the support plate about a second axis, wherein the foot pedal defines a top surface that is configured to receive a user's foot thereon, wherein deflection of the foot pedal about the second axis causes a corresponding rotation in a direction the trolling motor housing is oriented about the first axis; and a feedback device coupled with the foot pedal and configured to provide at least one of haptic, audible, or visual feedback to indicate to the user that rotation of the direction of the trolling motor housing has stalled or is about to stall;

a processor; and a memory including computer program code configured to, when executed, cause the processor to:

determine that rotation of the trolling motor housing about the first axis has stalled or is about to stall; and cause, in response to determining that rotation of the trolling motor housing about the first axis has stalled or is about to stall, the feedback device to provide the at least one of haptic, audible, or visual feedback.

2. The trolling motor system of claim 1 further comprising a steering assembly configured to steer the trolling motor housing about the first axis to a plurality of directions in response to deflection of the foot pedal about the second axis.

3. The trolling motor system of claim 2 further comprising an orientation sensor configured to determine the orientation of the direction of the trolling motor housing and a position sensor configured to determine a deflected position of the foot pedal, and wherein the computer program code is configured to determine that rotation of the trolling motor housing about the first axis has stalled or is about to stall based on orientation data from the orientation sensor and position data from the position sensor.

4. The trolling motor system of claim 3, wherein the computer program code is configured to:

determine an expected orientation of the trolling motor housing based on position data from the position sensor; and determine that rotation of the trolling motor housing about the first axis has stalled or is about to stall in an instance in which an actual orientation of the trolling motor housing is different than the expected orientation of the trolling motor housing.

5. The trolling motor system of claim 2 further comprising a motor current sensor configured to sense current draw utilized by a motor of the steering assembly during operation of the steering assembly to steer the trolling motor housing about the first axis, and wherein the computer program code is configured to determine that rotation of the trolling motor housing about the first axis has stalled or is about to stall based on monitored current draw of the motor from the motor current sensor.

6. The trolling motor system of claim 5, wherein the computer program code is configured to:

compare a current draw of the motor during operation to a predetermined current draw threshold; and determine that rotation of the trolling motor housing about the first axis has stalled or is about to stall in an instance in which the current draw of the motor is greater than the predetermined current draw threshold.

7. The trolling motor system of claim 1, wherein the processor is positioned within the trolling motor assembly.

8. The trolling motor system of claim 1, wherein the processor is positioned within the user input assembly.

9. A user input assembly for controlling operation of a trolling motor assembly, wherein the trolling motor assembly comprises a trolling motor, wherein the trolling motor is at least partially contained within a trolling motor housing, wherein the trolling motor housing is attached to a shaft of the trolling motor assembly and configured to rotate about a first axis of the shaft, the user input assembly comprising:

a support plate;

a foot pedal pivotably mounted to the support plate about a second axis, wherein the foot pedal defines a top surface that is configured to receive a user's foot thereon, wherein deflection of the foot pedal about the second axis causes a corresponding rotation in a direction the trolling motor housing is oriented about the first axis; and a feedback device coupled with the foot pedal and configured to provide at least one of haptic, audible, or visual feedback to indicate to the user that rotation of the direction of the trolling motor housing has stalled or is about to stall.

10. The user input assembly of claim 9 further comprising a processor and a memory including computer program code configured to, when executed, cause the processor to:

determine that rotation of the trolling motor housing about the first axis has stalled or is about to stall; and cause, in response to determining that rotation of the trolling motor housing about the first axis has stalled or is about to stall, the feedback device to provide the at least one of haptic, audible, or visual feedback.

11. The user input assembly of claim 10 further comprising a position sensor configured to determine a deflected position of the foot pedal, and wherein the computer program code is configured to determine that rotation of the trolling motor housing about the first axis has stalled or is about to stall based on orientation data from an orientation sensor of the trolling motor assembly and position data from the position sensor, wherein the orientation sensor is configured to determine the orientation of the direction of the trolling motor housing.

12. The user input assembly of claim 11, wherein the computer program code is configured to:

determine an expected orientation of the trolling motor housing based on position data from the position sensor; and determine that rotation of the trolling motor housing about the first axis has stalled or is about to stall in an instance in which an actual orientation of the trolling motor housing is different than the expected orientation of the trolling motor housing.

13. The user input assembly of claim 9, wherein the computer program code is configured to determine that rotation of the trolling motor housing about the first axis has stalled or is about to stall based on monitored current draw from a motor current sensor, wherein the motor current sensor is configured to sense current draw utilized by a motor of a steering assembly during operation of the steering assembly to steer the trolling motor housing about the first axis.

14. The user input assembly of claim 13, wherein the computer program code is configured to:

compare a current draw of the motor during operation to a predetermined current draw threshold; and determine that rotation of the trolling motor housing about the first axis has stalled or is about to stall in an instance in which the current draw of the motor is greater than the predetermined current draw threshold.

15. A trolling motor system comprising:

a trolling motor assembly configured for attachment to a watercraft, wherein the trolling motor assembly comprises:

a shaft defining a first axis, wherein the shaft defines a first end and a second end;

a trolling motor at least partially contained within a trolling motor housing, wherein the trolling motor housing is attached to the second end of the shaft, wherein, when the trolling motor assembly is attached to the watercraft and the trolling motor housing is submerged in a body of water, the trolling motor, when operating, is configured to propel the watercraft to travel along the body of water;

a handheld remote control device comprising:

a user interface configured to receive user input from a user, wherein the user input causes rotation in a direction the trolling motor housing is oriented about the first axis;

a wired or wireless communication element; and a feedback device configured to provide at least one of haptic, audible, or visual feedback to indicate to the user of the handheld remote control device that rotation of the direction of the trolling motor housing has stalled or is about to stall;

a processor; and a memory including computer program code configured to, when executed, cause the processor to:

determine that rotation of the trolling motor housing about the first axis has stalled or is about to stall; and cause, in response to determining that rotation of the trolling motor housing about the first axis has stalled or is about to stall, the feedback device to provide the at least one of haptic, audible, or visual feedback.

16. The trolling motor system of claim 15 further comprising a steering assembly configured to steer the trolling motor housing about the first axis to a plurality of directions in response to deflection of the foot pedal about the second axis.

17. The trolling motor system of claim 16 further comprising an orientation sensor configured to determine the orientation of the direction of the trolling motor housing, and wherein the computer program code is configured to determine that rotation of the trolling motor housing about the first axis has stalled or is about to stall based on orientation data from the orientation sensor.

18. The trolling motor system of claim 16 further comprising a motor current sensor configured to sense current draw utilized by a motor of the steering assembly during operation of the steering assembly to steer the trolling motor housing about the first axis, and wherein the computer program code is configured to determine that rotation of the trolling motor housing about the first axis has stalled or is about to stall based on monitored current draw of the motor from the motor current sensor.

19. The trolling motor system of claim 15, wherein the processor is positioned within the trolling motor assembly.

20. The trolling motor system of claim 15, wherein the processor is positioned within the handheld remote control device.

* * * * *